US005715685A

United States Patent [19]

Takasugi

[11] Patent Number: 5,715,685

[45] Date of Patent: Feb. 10, 1998

[54] METHOD AND APPARATUS FOR TRANSPORTING/STORING CHILLED GOODS

[75] Inventor: Mitsuo Takasugi, Kanagawa, Japan

[73] Assignee: Colpo Co., Ltd., Tokyo, Japan

[21] Appl. No.: 562,825

[22] Filed: Nov. 27, 1995

[30] Foreign Application Priority Data

Dec. 12, 1994 [JP] Japan ..... 6-332140

[51] Int. Cl.[6] ..... F17C 7/02

[52] U.S. Cl. ..... 62/52.1; 62/239; 62/384

[58] Field of Search ..... 62/45.1, 384, 239, 62/52.1

[56] References Cited

U.S. PATENT DOCUMENTS

| | | | |
|---|---|---|---|
| 3,287,925 | 11/1966 | Kane et al. | 62/239 |
| 3,570,262 | 3/1971 | Gramse | 62/239 |
| 3,792,595 | 2/1974 | Willis | 62/239 |
| 4,597,266 | 7/1986 | Entrekin | 62/384 |
| 4,825,666 | 5/1989 | Saia, III | 62/384 |
| 4,951,479 | 8/1990 | Araquistain et al. | 62/384 |

*Primary Examiner*—Ronald C. Capossela
*Attorney, Agent, or Firm*—Browdy and Neimark

[57] ABSTRACT

In the method and apparatus for transporting/storing chilled goods at a low temperature: a supply area of a liquefied gas such as liquid carbon dioxide, liquefied nitrogen and the like is provided in an upper portion of a hermetically-sealed space; and, the liquefied gas is supplied to the supply area to rapidly chill the interior of the space, whereby such interior is kept thereafter at the substantially same temperature as that of a surface of the chilled goods. The supply area has its bottom and/or side surface constructed of a gas-permeable material such as perforated panels, mesh members, net members and like materials, or of a gas-impermeable thin material such as aluminum foil, synthetic resin sheet or thin panels, metal sheet, non-woven fabrics and like materials.

19 Claims, 20 Drawing Sheets

METHOD AND APPARATUS FOR TRANSPORTING/STORING CHILLED GOODS

BACKGROUND OF THE INVENTION

1. Field of the Invention

The present invention relates to a method for efficiently transporting/storing goods which ones are controlled in temperature so as to be kept cool, the goods comprising perishables such as vegetables, fishes and shellfishes and like living aquatic resources, live flowers, medical supplies and the like. The present invention also relates to an apparatus for carrying out the above method.

2. Description of the Prior Art

In short-range transportation of chilled goods such as fruits, vegetables, fishes and shellfishes and the like, a cold-reserving aluminum van has been used. The van has its interior backed with a heat-insulating wall and cooled by means of dry ice and ice. On the other hand, in long-range transportation of frozen fishes, frozen meat and like frozen food, a chill car or a refrigerator is used to keep the interior of a fright compartment of the chill car or the interior of the refrigerator at a predetermined temperature. The chill car is provided with a mechanical refrigerating machine on the roof of its driver's cab or in a front upper portion of its freight compartment. In the chill car, the refrigerating machine is driven by a motor of the car or by a separate motor. In some type of the chill car, the mechanical refrigerating machine is replaced with a cooling-gas injection system for injecting a cooling gas such as liquefied nitrogen and the like into the freight compartment of the chill car.

Of the above, one cooling its freight compartment by means of dry ice and ice is inferior to the remaining ones in cooling capacity and easiness in temperature control, and, therefore it is difficult to keep the interior of the freight compartment of such one in a desired temperature range for a long time. As a result, the van having its freight compartment cooled by means of dry ice and ice is considerably limited in selection of goods and delivery range thereof. Further, in case of the chill car provided with the mechanical refrigerating machine or with the liquefied-nitrogen injection system comprising a high-pressure cylinder, the car is disadvantageous in that it is difficult for the car to save weight, space and running cost because of the presence of the the mechanical refrigerating machine, high-pressure cylinder and like additional components. In addition, when a door of the freight compartment of the chill car is frequently opened and closed in loading/unloading operations of the goods, it becomes more difficult to control in temperature the fright compartment of the car. In case of the chill car carrying the high-pressure cylinder, since the cylinder must be carefully treated, the car is inferior to the others in easiness in operation and in safety.

As described above, the conventional method for transporting/storing the chilled goods suffers from many problems, and is poor in transportation efficiency in most cases.

SUMMARY OF THE INVENTION

Under such circumstances, the present invention was made. Consequently, it is an object of the present invention to provide a method for transporting/storing chilled goods, which method is excellent in easiness in operation, and enables its user to carry out the method with minimum weight and space, to control in temperature the chilled goods in a desirable manner and to realize land, water and air transportation of the chilled goods efficiently from the economical point of view, and also to store the chilled goods in a desirable manner.

It is another object of the present invention to provide an apparatus for transporting/storing the chilled goods which ones are stored in a freight compartment of the apparatus and kept at a proper temperature therein, in which apparatus neither refrigerator nor high-pressure cylinder is required in transportation and storing of the chilled goods, which enables the apparatus to save running costs and space.

It is further another object of the present invention to provide a method and apparatus for transporting/storing the chilled goods to facilitate distribution of the chilled goods.

It is still further another object of the present invention to provide a storage facility of the chilled goods such as an automatic warehouse for efficiently storing the chilled goods without involving any additional running costs.

Other and further objects, features and advantages of the present invention will appear more fully from the following description.

The above objects of the present invention are accomplished by providing:

A method for transporting/storing chilled goods at a low temperature, characterized in that:

- a supply area of a liquefied gas such as liquid carbon dioxide, liquefied nitrogen and the like is provided in an upper portion of a hermetically-sealed space;
- the liquefied gas is supplied to the supply area to rapidly chill the interior of the space, whereby the interior of the space is kept thereafter at the substantially same temperature as that of a surface of the chilled goods; and,
- the supply area has its bottom and/or side surface constructed of a gas-permeable material such as perforated panels, mesh members, net members and like materials, or constructed of a gas-impermeable thin material such as aluminum foil, synthetic resin sheet or thin panels, metal sheet, non-woven fabrics and like materials.

DESCRIPTION OF THE PREFERRED EMBODIMENTS

Figure 1:
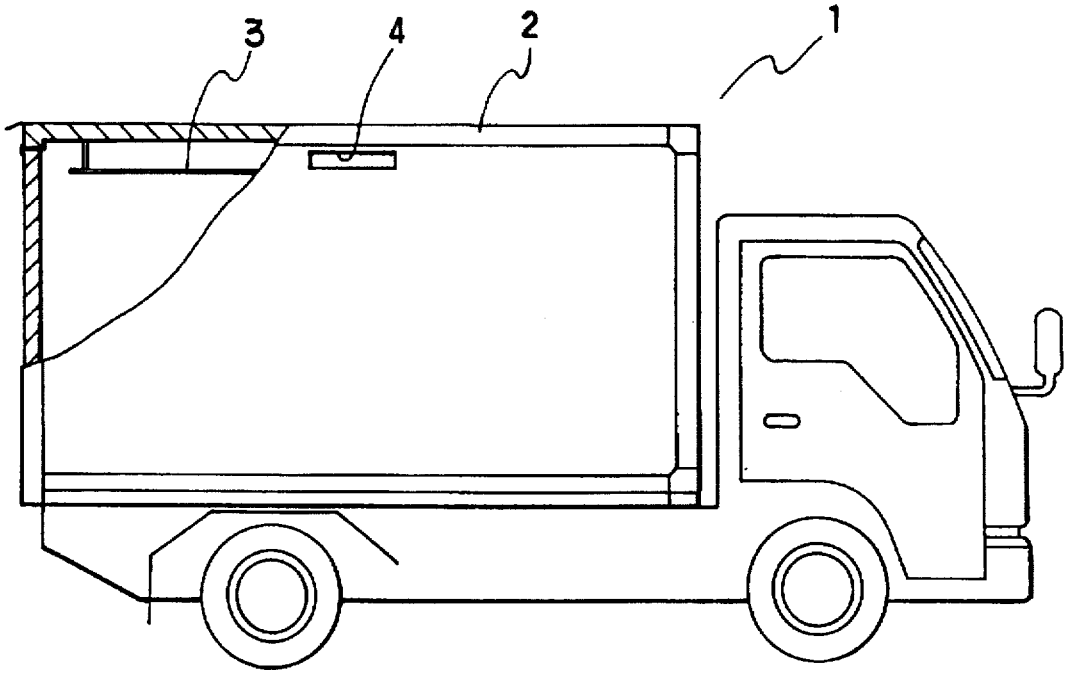
FIG. 1 is a partially broken side view of a delivery van or transport vehicle for carrying out the method of the present invention.
Figure 2:
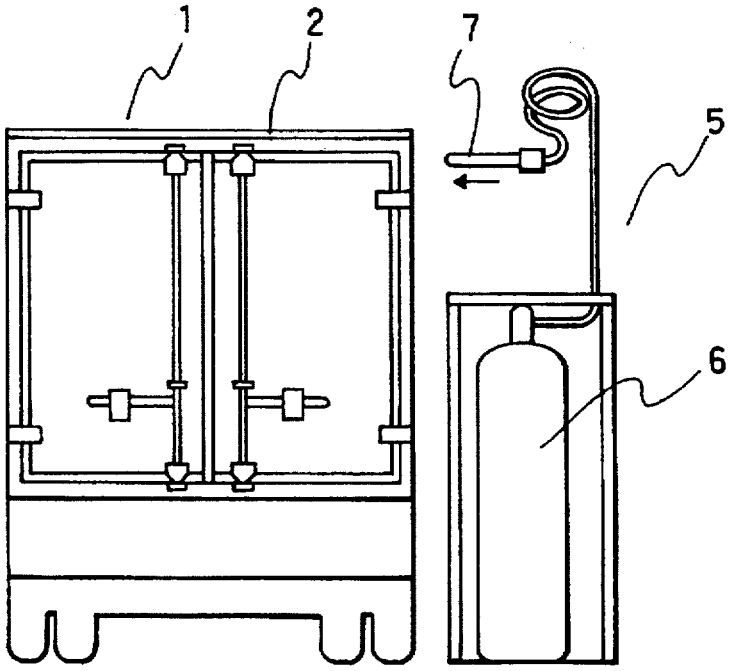
FIG. 2 is a rear view of the transport vehicle shown in FIG. 1.

Hereinbelow, the present invention will be described in detail with reference to the accompanying drawings.

In the present invention, in order to control chilled goods in temperature (i.e., to keep them at a proper low temperature), a cooling gas (i.e., liquefied gas such as liquid carbon dioxide, liquefied nitrogen and the like) is injected into a thermally-insulated and hermetically-sealed space, for example such as a freight compartment of a thermally-insulated vehicle containing the chilled goods, containers (which comprise returnable hard containers, non-returnable foamed-plastic containers and like containers), warehouses, and like facilities.

Liquid carbon dioxide is contained in a high-pressure cylinder at a pressure of 20 Kg F per square centimeter G. The cylinder is thermally insulated by means of vacuum. When liquid carbon dioxide contained in the high-pressure cylinder is injected from the cylinder at room temperature, such carbon dioxide expands in volume approximately 280 times, and approximately 47 percent thereof becomes snowy dry ice while the remaining one (i.e., approximately 53 percent of such carbon dioxide) becomes gas.

Since cold energy is accumulated in such snowy dry ice, a temperature of the snowy dry ice decreases up to an extremely low value of −78 degrees centigrade, which makes it possible to rapidly cool the interior of the thermally-insulated and hermetically-sealed space above mentioned. Snowy dry ice formed on a snow support (which one is, as described later, mounted in the freight compartment, containers and the like) realizes a rapid heat exchange to rapidly cool the interior of the compartment and the like. In case of a hard container described later, a temperature of air and wall surfaces inside the container often decreases up to −30 to −40 degrees centigrade in few minutes. A temperature of the interior thus cooled is then returned to the substantially same temperature as that of a surface of the chilled goods (which temperature of the surface is hereinafter referred to as the saturation temperature or point). A time necessary for the interior to reach the saturation temperature depends on conditions, and is generally within a range of from 20 minutes to several hours. It is possible for the hermetically sealed container to control in temperature its interior for at least 12 hours.

On the other hand, since the air confined in the container is replaced with the liquefied gas thus supplied, an atmosphere inside the container changes in composition to realize various desirable effects (hereinafter referred to as the gas packing effect). This effect is already utilized to prevent processed foods from oxidizing, i.e., to prevent aerobic bacteria from propagating in meat and fishes so as to prevent these foods from changing in quality and appearance, or to prevent vegetables from ripening so as to keep them fresh for a long period of time.

Incidentally, as for frozen goods capable of having its surface directly exposed to snowy dry ice without getting involved in any problems, it is possible to omit the snow support.

Now, an apparatus for carrying out the method of the present invention for transporting/storing chilled goods will be described with reference to the accompanying drawings.

As shown in FIGS. 1 to 5, an embodiment of the apparatus of the present invention is a delivery van or transport vehicle for transporting/storing the chilled goods.

In the drawings, the reference numeral 1 denotes the transport vehicle of the chilled goods for carrying out the method of the present invention for transporting/storing the chilled goods. The transport vehicle 1 is provided with a rear door and a box-type aluminum freight compartment 2. The compartment 2 has its inner walls backed with a heat-insulating material. In the transport vehicle of the present invention, neither refrigerating machine nor high-pressure cylinder is required in contrast with the case of conventional cold-reserving vehicles. Mounted in a ceiling portion of the freight compartment of the transport vehicle according to the present invention so as to be spaced apart from the ceiling portion by a predetermined distance is the snow support 3 constructed of a gas-permeable material such as perforated panels, mesh members, net members and like materials, or constructed of a gas-impermeable thin material such as aluminum foil, synthetic resin sheet or thin panels, metal sheet, non-woven fabrics and like materials. In case of the snow support 3 constructed of the gas-permeable material, since the snow support 3 permits the cooling gas to pass therethrough, a temperature of the interior of the freight compartment reaches to the saturation point in a relatively short period of time. In contrast with this, in case of the snow support 3 constructed of the gas-impermeable material, since the snow support 3 prevents the cooling gas from passing therethrough (i.e., prevents a heat exchange of the cooling gas), a relatively long period of time is required for the interior of the freight compartment to reach the saturation point.

Selection of the snow support 3 in material depends on types and properties of the goods to be controlled in temperature. More specifically, in case that the snow support is constructed of the gas-permeable material, the snowy dry ice formed on the snow support rapidly sublimes so that the temperature of a surface of the goods only slightly decreases. On the other hand, in case that the snow support is constructed of the gas-impermeable material, the snowy dry ice slowly sublimes to stay there longer so that the temperature of the surface of the goods considerably decreases. Consequently, a time required for the goods to reach the saturation point becomes longer, which makes the available term of refrigeration of the goods longer. This is true in any one of additional embodiments (described later).

Incidentally, in case of the transport vehicle for exclusively transporting frozen foods such as frozen fishes, frozen meat and the like, it is possible to omit the snow support 3 since there is no problem even when the liquefied gas is directly injected to such goods.

Figure 3:
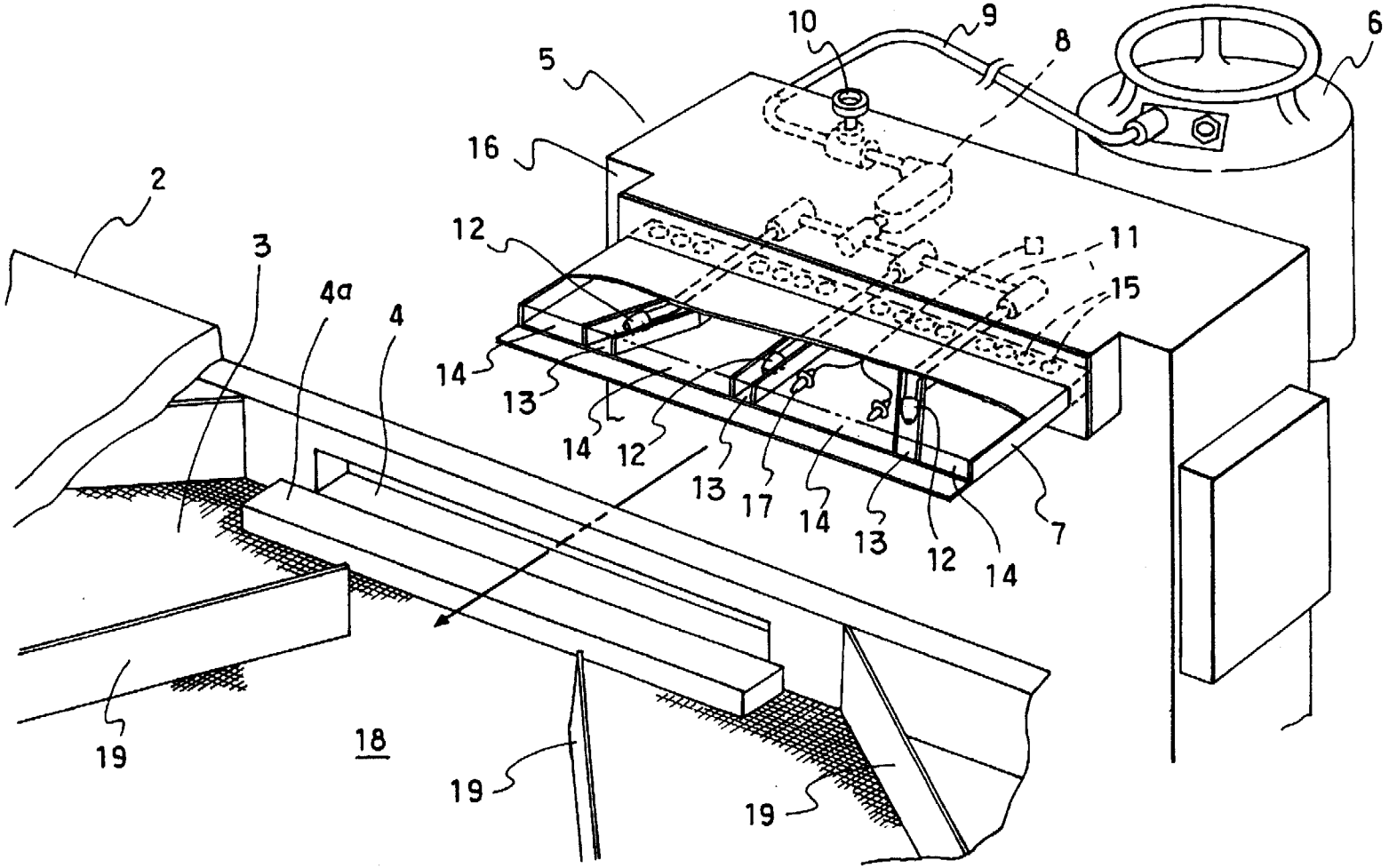
FIG. 3 is a partially broken perspective view of an essential part of the transport vehicle shown in FIG. 1.
Figure 4:
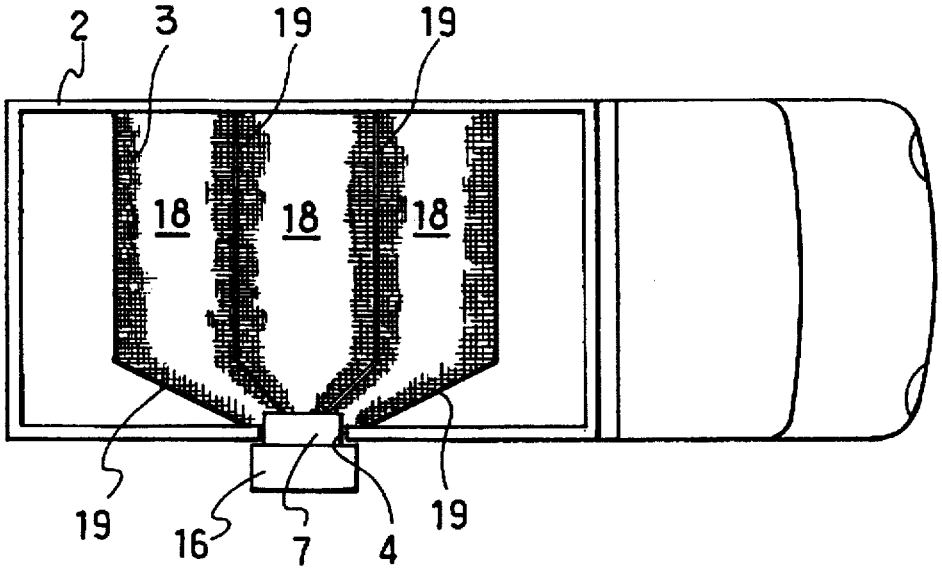
FIG. 4 is a sectional plan view of the transport vehicle shown in FIG. 1, taken along a horizontal plane.

Formed above the snow support 3 in an upper portion of the side surface of the freight compartment of the transport vehicle is a liquefied-gas supply port 4 opening into the compartment. As shown in FIG. 3, the supply port 4 is provided with a lid 4*a*. The lid 4*a* is opened when pushed from outside through the use of an external force. When the external force is removed, the lid 4*a* closes the supply port 4 under the influence of a resilient force exerted by a spring, magnet or like means. The lid 4*a* is ordinarily closed, except that an insertion element 7 (described later) is inserted into the supply port 4. In FIG. 3, the lid 4*a* is opened.

A liquefied-gas supply unit 5, which is installed in production-area plants, delivery centers and like facilities, is provided with a liquefied-gas cylinder 6 and a liquefied-gas supply insertion element 7, the liquefied-gas cylinder 6 containing liquid carbon dioxide, liquefied nitrogen and the like. In use, since the insertion element 7 is inserted into the liquefied-gas supply port 4, these components 4, 7 correspond to each other in shape of their mating portions. In cross-sectional shape, though the insertion element 7 may assume any desirable shape such as a circular shape, square shape and like shapes, preferably, it assumes a flat horizontally-elongated box-like shape. The liquefied gas thus supplied is converted into a solid phase thereof on the snow support 3, i.e., in case of liquid carbon dioxide, part of the liquid carbon dioxide thus supplied is converted into snowy dry ice to cool the freight compartment.

Now, with reference to FIG. 3, both the snow support 3 and the insertion element 7 will be described in detail. As shown in FIG. 3, a solenoid valve 8 is connected with the high-pressure cylinder 6 through a high-pressure hose 9 and a pressure regulating valve 10. Connected with the solenoid valve 8 is a branch nozzle 11 having a plurality of branches the number of which is three in the embodiment shown in FIG. 3. Each of the branches is provided with a front-end nozzle opening 12 in its free end. In use, each of the front-end nozzles 12 is inserted into each of a plurality of injection passage 13 formed in the insertion element 7. Of the injection passages 13, a central one directs the liquefied gas in an insertion direction of the insertion element 7 being inserted into the liquefied-gas supply port 4, while outer ones direct the liquefied gas in directions outwardly deviated from such insertion direction. The reason is that it is necessary to uniformly spread the cooling gas throughout the freight compartment which one is divided into a plurality of segments, as shown in FIG. 3.

Formed between the injection passages 13 are hollow mufflers 14 each of which opens in its front end only. Formed in an upper surface of a rear-end portion (which is not inserted into the liquefied-gas supply port 4) of each of the hollow mufflers 14 are a plurality of gas vent holes 15. In action, the mufflers 14 serve to receive and discharge the pressure of the highly-compressed gas thus injected. Incidentally, the gas vent holes 15 are so arranged as to be disposed in a main body 16 of the liquefied-gas supply unit 5. In FIG. 3, the reference numeral 17 denotes a temperature sensor mounted in the mufflers 14.

As described in the above, a cooling room 18 is generally divided into a plurality of segments by means of partitions 19. The number of the segments is three in an embodiment shown in FIG. 8, in which each of the segments forms an independent cooling rooms (i.e., snow supports 3). In this case, each of the partitions 19 in the vicinity of the liquefied-gas supply port 4 is set at a predetermined incline from the injection direction of the cooling gas, as is clearly shown in FIG. 4. The cooling gas injected from the injection passages 13 is so guided as to uniformly spread throughout the individual segments of the cooling room.

The temperature of the interior of the cooling room may be controlled by adjusting the amount of the liquefied gas being supplied to the room, or by providing and moving a slidable control plate under the snow support 3 to control in area size a cooling-gas discharge area in each of the segments of the cooling room. Incidentally, it is also possible to provide an independent liquefied-gas supply port 4 in each of the segments of the cooling room. Further, it is also possible to reserve one of the segments by the use of the slidable control plate mentioned above.

Figure 5:
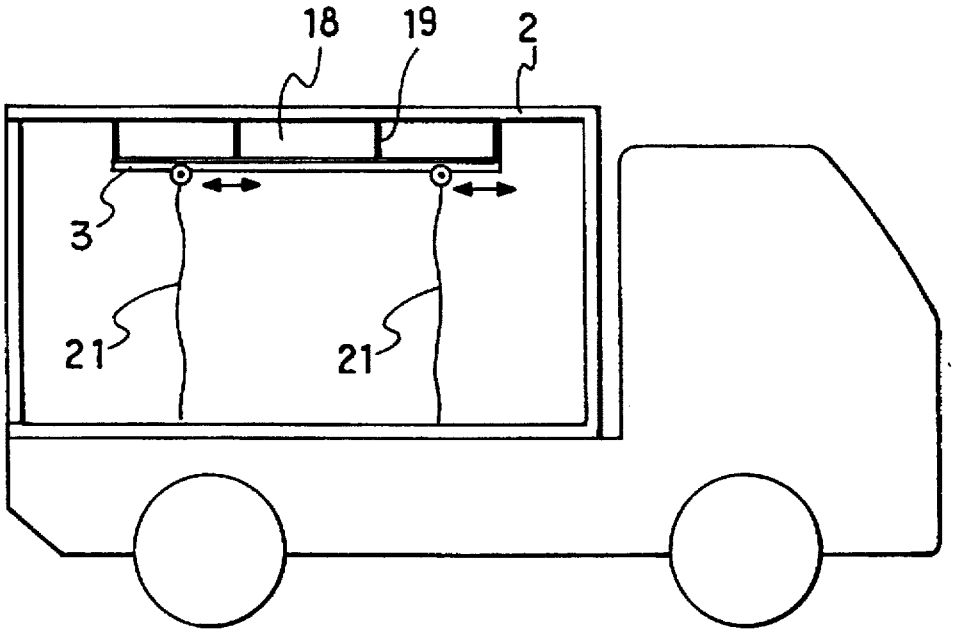
FIG. 5 is a longitudinal sectional view of another embodiment of the transport vehicle for carrying out the method of the present invention.

In FIG. 5, the reference numeral 21 denotes a curtain which is suspended from a bottom surface of the snow support 3 to reach a floor of the freight compartment 2 of the transport vehicle. A plurality of the curtains 21 are provided in the freight compartment 2. Each of the curtains 21 is preferably movable in a longitudinal direction (shown by the arrows in FIG. 5) of the transport vehicle. Naturally, these curtains 21 serve to prevent the cooling gas from escaping from the freight compartment 2 when the rear door of the compartment 2 is opened. It is also possible to partition the compartment 2 into cubicles which ones enable a user to classify the goods into several types according to delivery addresses.

Although the liquefied-gas supply unit 5 may be manually controlled, it may be also controlled automatically. In automatic control, the insertion element 7 is coupled with an industrial robot having two (i.e., y- and z-axis) or three (i.e., x-, y- and z-axis) independent axes of motion, while provided with a sensor to detect a position of the liquefied-gas supply port 4. In operation, when the transport vehicle stops in a predetermined position, the robot starts its operation based on a signal issued from the sensor, so that the insertion element 4 is automatically guided to the liquefied-gas supply port 4.

The transport vehicle described above is so designed as to transport the goods directly to its destination, and, therefore not unloaded before it reaches the destination, which makes it easy to control the temperature of the freight compartment 2. In case that the transport vehicle is unloaded before it reaches the destination, the curtains 21 are used for supporting the temperature control of the freight compartment 2. In a mid-range transportation, the transport vehicle may use a transfer station for supplying the liquefied gas to the vehicle.

Figure 6:
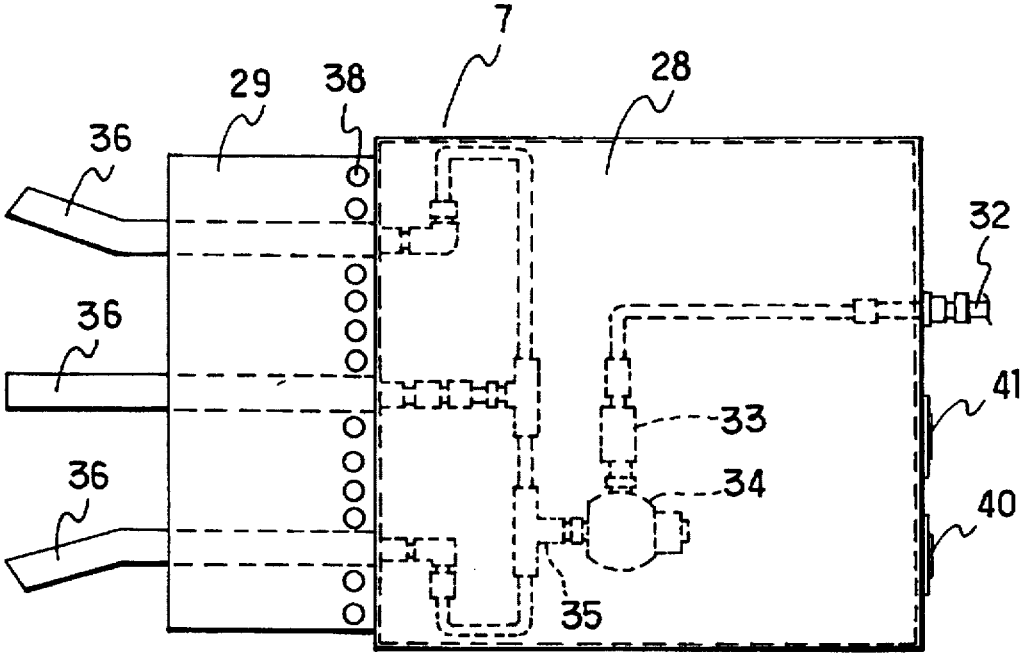
FIG. 6 is a plan view of an embodiment of an insertion element of the liquefied-gas supply unit used in the present invention.
Figure 7:
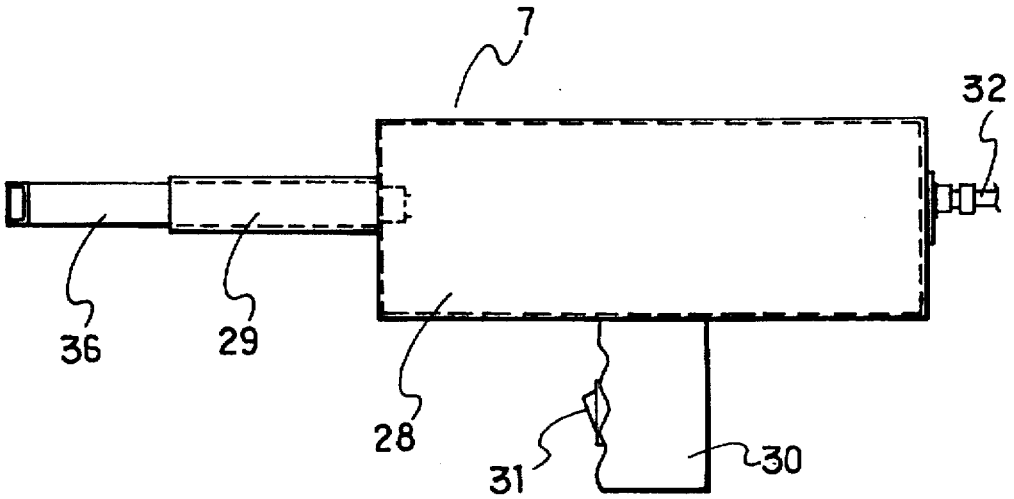
FIG. 7 is a side view of the insertion element shown in FIG. 6.
Figure 8:
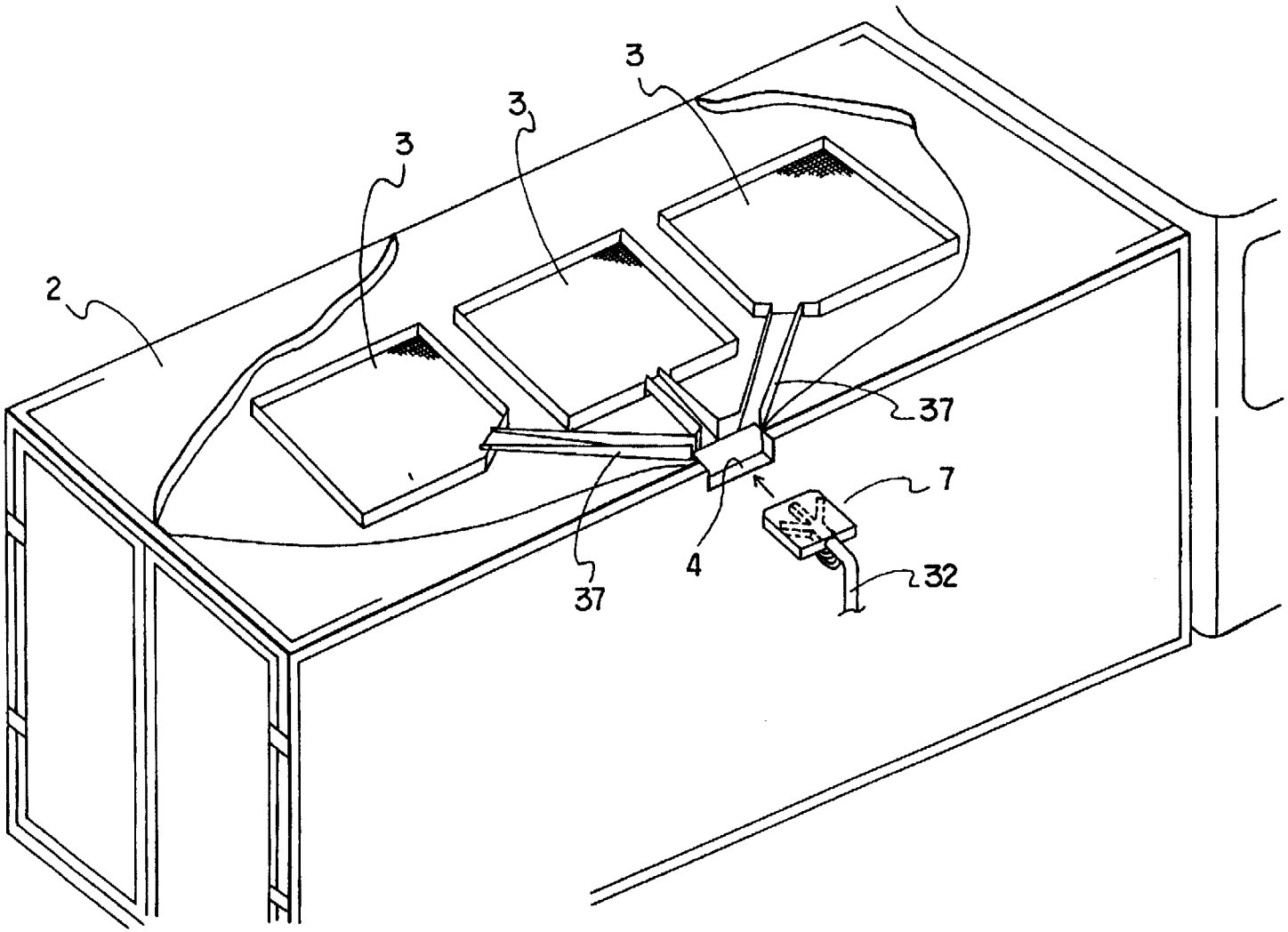
FIG. 8 is a partially broken perspective view of the insertion element shown in FIG. 6, illustrating its mounting condition in the transport vehicle.

Another embodiment of the insertion element 7 is shown in FIGS. 6 to 8. In this embodiment, the insertion element 7 is of a handy type constructed of a box-like casing 28 and an insertion portion 29 extending from the casing 28. The casing 28 is provided with a grip 30 in a central portion of its lower surface. In general, a switch 31 is also provided in the lower surface of the casing 28 so as to be disposed in front of the the grip 30. A gas tubing 32 extending from the liquefied-gas cylinder 6 is inserted into the casing 28 and has its front end connected with a solenoid valve 34 through a pressure regulating valve 33.

The solenoid valve 34 is connected with a branch nozzle 35 having a plurality of branches, each of which is connected with each of a plurality of injection passages 36 formed in the insertion portion 29 of the casing 28. As is in the preceding embodiment shown in FIGS. 1 to 5, of the injection passages 36, a central one directs the liquefied gas in an insertion direction of the insertion element 7 being inserted into the liquefied-gas supply port 4, while outer ones direct the liquefied gas in directions outwardly deviated from such insertion direction. The reason is that it is necessary to have these outer ones 36 correspond in direction to outer ones of gas passages 37 extending from the liquefied-gas supply port 4 to the individual snow supports 3, the number of which supports 3 is three in the embodiment shown in FIG. 8.

Formed between the injection passages 36 of the insertion portion 29 of the casing 28 are hollow mufflers each of which opens in its front end only. If necessary, a gas vent hole 38 is formed in an upper surface of a rear-end portion (which is not inserted into the liquefied-gas supply port 4) of each of the hollow mufflers. In action, the mufflers serve to receive and discharge the pressure of the highly-compressed gas thus injected. Incidentally, though not shown in the drawings, a temperature sensor may be mounted in the mufflers as is in the preceding embodiment shown in FIG. 3 to control the solenoid valve 34 in operation.

In FIG. 6: the reference numeral 40 denotes a temperature controlling meter; and, 41 a timer. Both of the temperature controlling meter 40 and the timer 41 are fixedly mounted on a rear surface of the casing 28. It is possible to modify the embodiment of the present invention so as to provide three modifications of the insertion element 7. Of these modifications: a first one is provided with the timer 41 but not provided with any of the sensor and the temperature controlling meter 40; a second one is provided with both the sensor and the temperature controlling meter 40 but not provided with the timer 41; and, a third one is provided with any of the timer 41, sensor and the temperature controlling meter 40.

When the liquefied gas is supplied to the freight compartment 2 of the transport vehicle, the user holds the insertion element 7 in its grip 30 and inserts the insertion portion 29 of the element 7 into the liquefied-gas supply port 4. Since the injection passages 36 communicate with the gas passages 37, when the switch 31 is turned on to open the solenoid valve 34, the liquefied gas injected from the high-pressure cylinder 6 is guided to the individual injection passages 36 through the branch nozzle 35 and then injected into the individual gas passages 37. Part of the liquefied gas thus injected is converted into a "snow" layer or a layer of snowy dry ice on the snow support 3 when the support 3 is provided in the freight compartment 2 of the transport vehicle, so that the interior of the compartment 2 is cooled in a short period of time. In case that there is no snow support 3 in the compartment 2, the goods contained in the compartment 2 is directly exposed to the liquefied gas thus injected, and, therefore rapidly refrigerated.

The timer 41 or the sensor described above may automatically determine the completion of supplying operation of the liquefied gas to the compartment 2. In other words, in case of the control conducted by the use of the timer 41, since it is possible to previously know the amount of the liquefied gas to be supplied to the fright compartment 2 based on the capacity thereof, the use merely sets the timer 41 in accordance with such known amount of the liquefied gas. On the other hand, in case of the control conducted by the use of the sensor, the temperature controlling meter 40 is set at a predetermined temperature. When the sensor detects such predetermined temperature, the sensor issues a signal to the solenoid valve 34 to close the same so that the supplying operation of the liquefied gas is completed.

Figure 9:
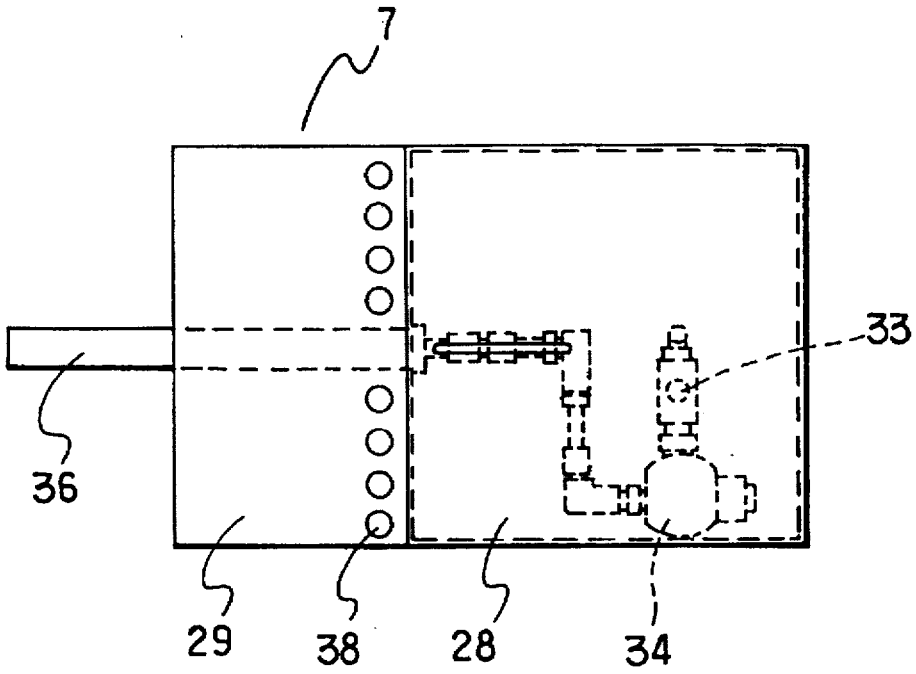
FIG. 9 is a plan view of a modification of the insertion element shown in FIG. 6.
Figure 10:
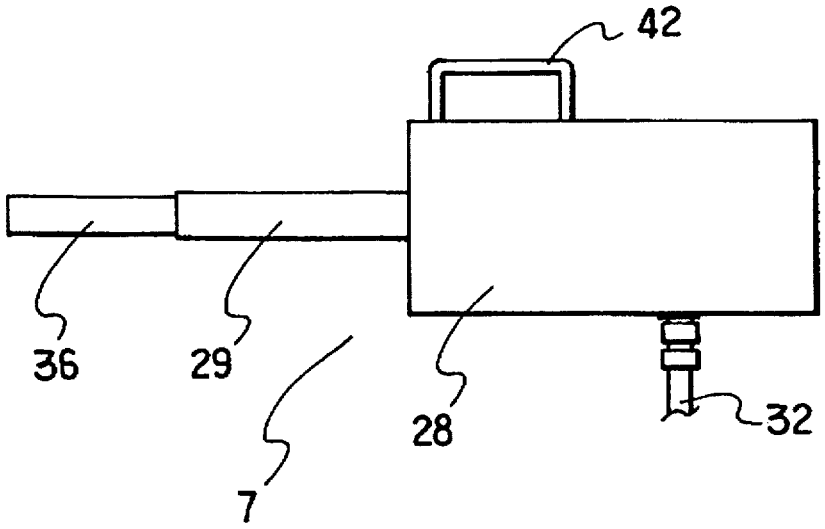
FIG. 10 is a side view of the modification shown in FIG. 9.

FIG. 9 shows another embodiment of the insertion element 7 in which a single injection passage 36 is formed. In this case, the liquefied-gas supply port 4 may assume a simple circular shape for receiving the injection passage 36. Although the remaining construction of the insertion element 7 of the embodiment shown in FIG. 9 is the substantially same as that of the preceding embodiment shown in FIG. 6, the embodiment shown in FIG. 9 may omit the provision of the insertion portion 29 in the insertion element 7. On the other hand, in the embodiment shown in FIG. 9, a handle 42 is used in place of the grip 30 shown in FIG. 7, the handle 42 being fixedly mounted on an upper surface of the casing 28 of the insertion element 7.

Figure 26:
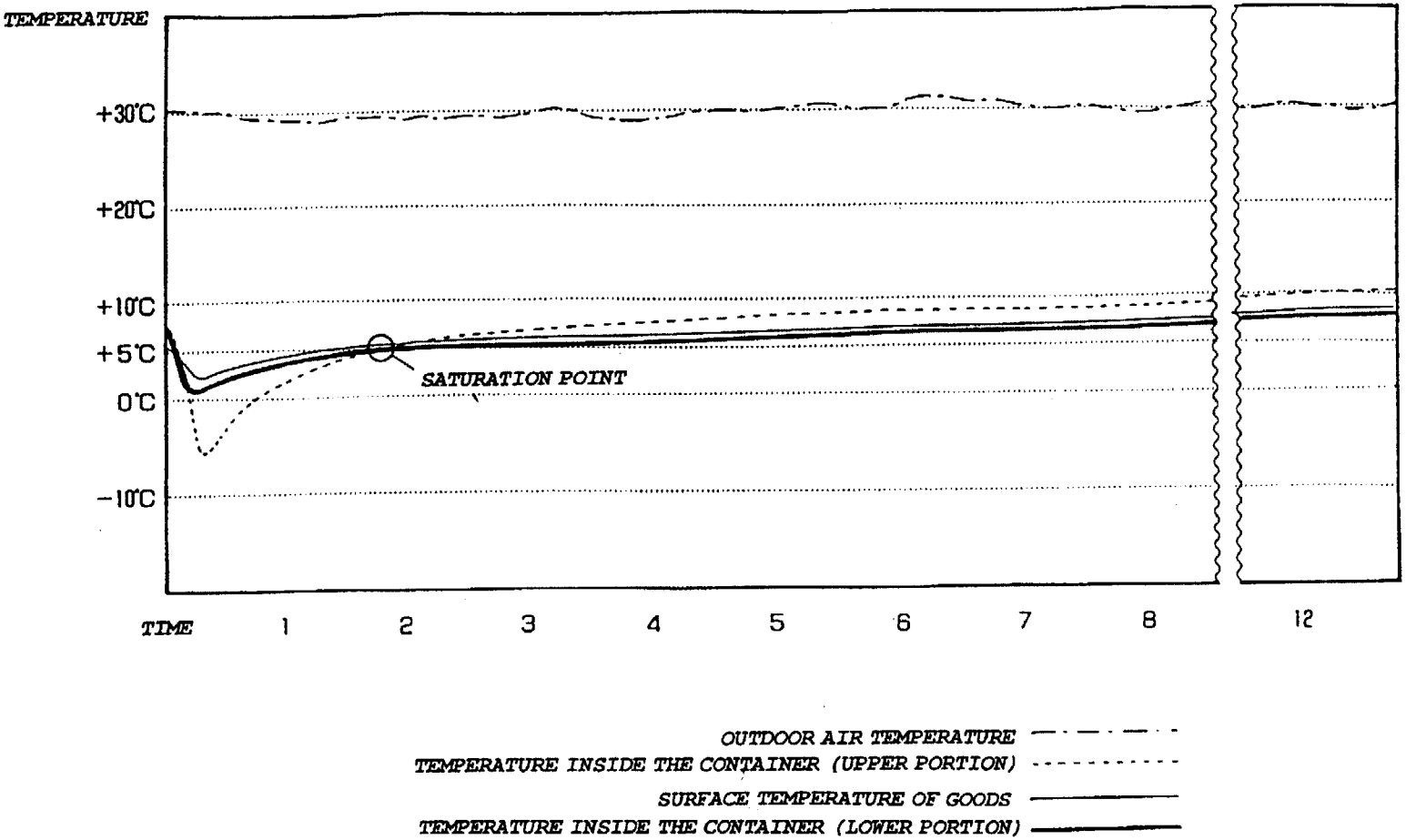
FIG. 26 is a graph showing temperature variations (with elapsed time for 12 hours) in: an upper and a lower portion of the freight compartment of the transport vehicle carrying out the method of the present invention; a surface of the goods; and, outdoor air.

FIG. 26 is a graph of temperature variations of the goods contained in the freight compartment 2 of the transport vehicle provided with the snow support 3 of a net type, illustrating the temperature data of lettuce a surface temperature of which is −5 degrees centigrade. The graph illustrates variations (with elapsed time for 12 hours) of the outdoor air temperature, surface temperature of the goods, and the temperature of the interior of the freight compartment 2. According to this graph, after completion of the supplying operation of the liquefied gas to the freight compartment 2 containing the goods, the temperature of an upper portion of the compartment 2 decreases to a temperature of −5 degrees centigrade in 20 minutes. At the same time, the surface temperature of the goods also decreases to a temperature of +2.5 degrees centigrade. After that, both of the temperatures gradually increase. Namely, the temperature of the upper and the lower portion of the compartment 2 approaches the surface temperature of the goods, and then reaches the saturation point. In this case, the time taken for the goods to reach the saturation point was approximately one and three quarter hours. After reaching the saturation point, all the temperatures mentioned above were not subjected to large variations. Namely, after the elapse of 12 hours, the increase in surface temperature of the goods was only approximately 3 degrees centigrade. Such increase in surface temperature does not affect in quality the goods at all. Consequently, it is easily understood that the transport vehicle 1 carrying out the method of the present invention performs a sufficient temperature control of the chilled goods in transportation and delivery thereof.

Figure 11:
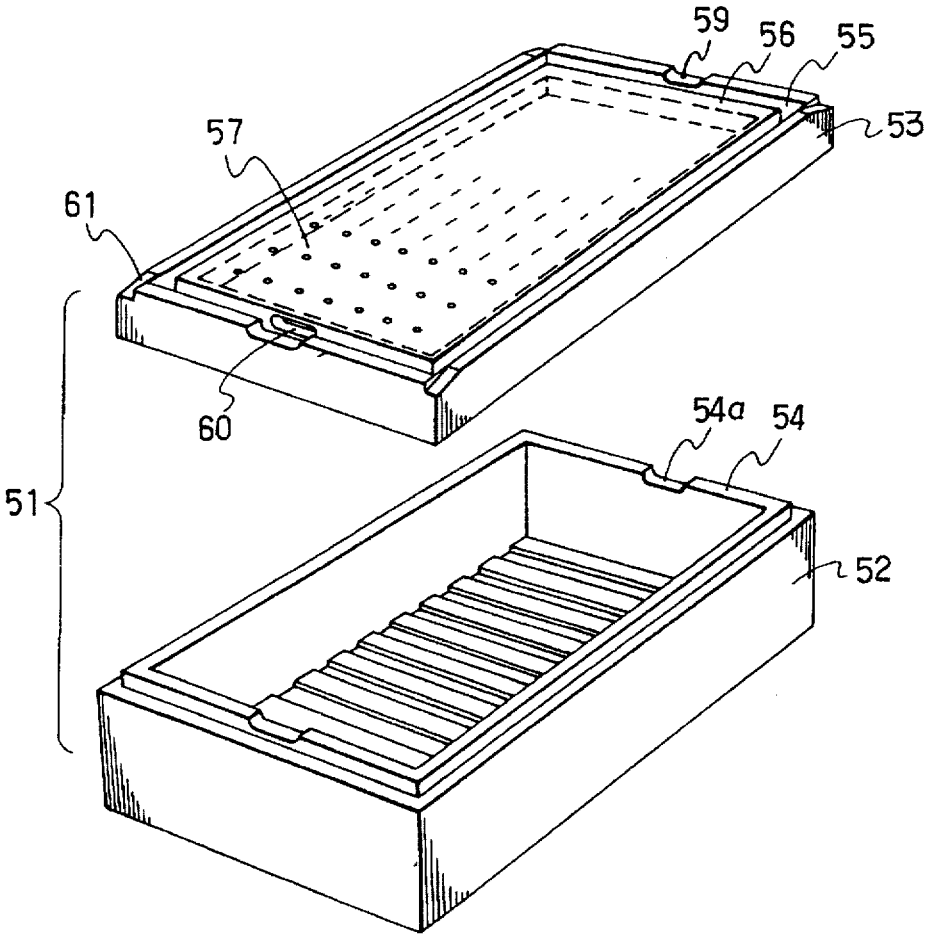
FIG. 11 is a perspective view of a foamed plastic container for carrying out the method of the present invention.
Figure 12:
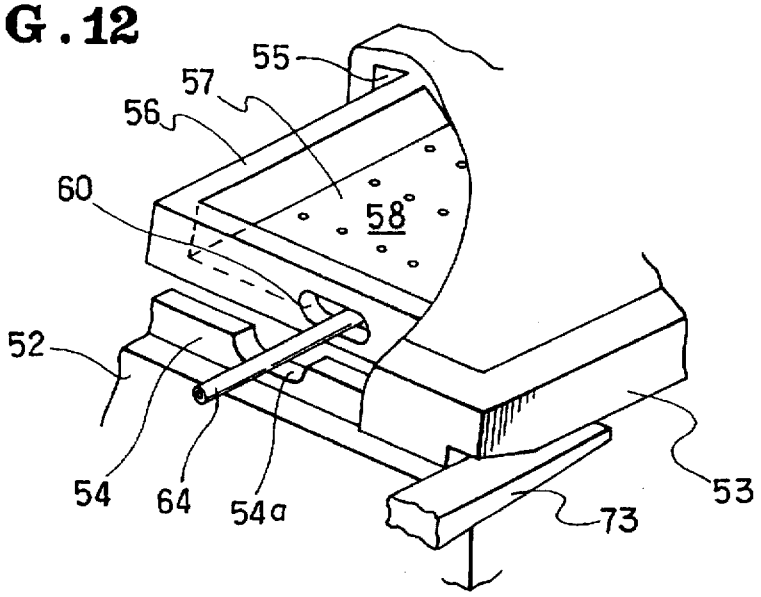
FIG. 12 is a partially broken perspective view of an essential part of the container shown in FIG. 11.

FIGS. 11 and 12 show an embodiment of a foamed plastic temporarily-used container (hereinafter referred to as the foamed container 51) of a nonreturnable type used in the present invention.

The foamed container 51 is constructed of a foamed plastic container body 52 and a foamed plastic lid 53. Provided in an upper surface of the container body 52 is an annular ridge 54 inserted into a corresponding annular groove 55 of the lid 53. The. groove 55 is formed outside an annular wall 56, which is formed in a rear surface of the lid 53. The annular wall 56 is backed with the snow support 57 made or constructed of a gas-permeable material such as perforated panels, mesh members, net members and like materials, or made or constructed of a gas-impermeable thin material such as aluminum foil, synthetic resin sheet or thin panels, metal sheet, non-woven fabrics and like materials, whereby a liquefied-gas supply area 58 is defined by a rear surface of the lid 53, annular wall 56 and the snow support 57. Incidentally, it is also possible to apply the gas-permeable material or the gas-impermeable material to the annular wall 56.

A lower concave portion **54*a* is formed in a central portion of at least one of opposite short sides of the rectangular annular ridge 54 of the container body 52. On the other hand, as is clear from FIG. 11, an upper concave portion 59 is formed in a central portion of at least one of opposite short sides of the lid 53 so as to correspond in position to the lower concave portion 54*a* of the container body 52. When the container body 52 is completely closed with the lid 53, the upper concave portion 59 of the lid 53 is so disposed as to be parallel to but vertically offset from and disposed lower than the lower concave portion 54*a* of the container body 52. Consequently, when the lid 53 has one of its opposite short sides slightly moved up, the upper concave portion 59 of the lid 53 is moved into facing engagement with the lower concave portion 54*a* of the container body 52 to form an opening, which a cooling-gas supply nozzle (described later) passes through. Further, a nozzle insertion port 60 is formed in the annular wall 56 of the lid 53 so as to correspond in position to the upper concave portion 59 of the lid 53 in a condition in which the container body 52 is completely closed with the lid 53. Consequently, the nozzle insertion port 60 opens into the cooling-gas supply area 58 shown in FIG. 12. Incidentally, as shown in FIG. 11, preferably, a wedge-type notch 61 for permitting a lifting member 73 (described later) to enter a gap between the lid 52 and the container body 52 is formed in at least one of opposite ends of the short side of the lid 53, the short side being provided with the upper concave portion 59. The notch 61 may be formed in the container body 52, instead of in the lid 53**.

Any of the upper concave portion 59, lower concave portion **54*a* and the notch 61 is required for the lifting operation of the short side of the lid 53, which operation is required when the liquefied gas is supplied to the container 52. However, these components 59, 54*a* and 61 are not required in any of additional constructions show in FIGS. 13(A), 13(B) 13(C) and 13(D), which additional constructions permit the liquefied gas to be supplied to the container 52 without lifting the short side of the lid 53 relative to the container body 53. In any one of these additional constructions, a nozzle insertion port 62 assuming a proper shape such as circular shapes and the like is formed in an abutting area between the lid 53 and the container body 52. A leaf spring 63 for closing the nozzle insertion port 62 in ordinary conditions is fixedly mounted on at least one of the lid 53 and the container body 52 in an outside or an inside of the nozzle insertion port 62. In action, when the nozzle 64 pushes the leaf spring 63 from outside, the leaf spring 63 bends inward at its intermediate portion, i.e., in an insertion direction of the nozzle 64 to permit the nozzle 64 to enter the nozzle insertion port 62**.

Figure 13A:
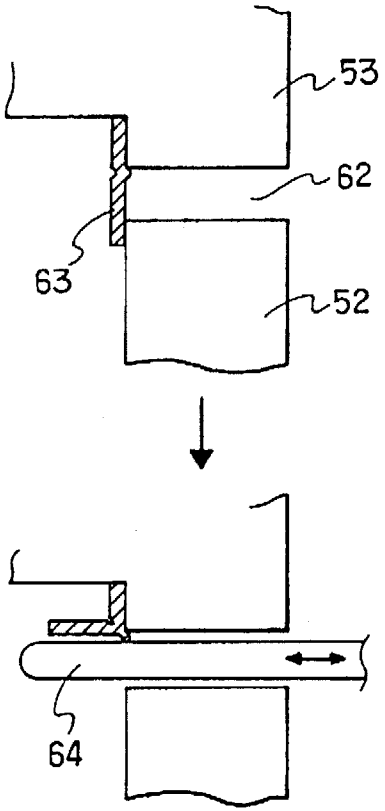
FIGS. 13(A), 13(B), 13(C) and 13(D) are longitudinal sectional views of various types of a nozzle insertion port of the container shown in FIG. 11, illustrating their insertion conditions.
Figure 13B:
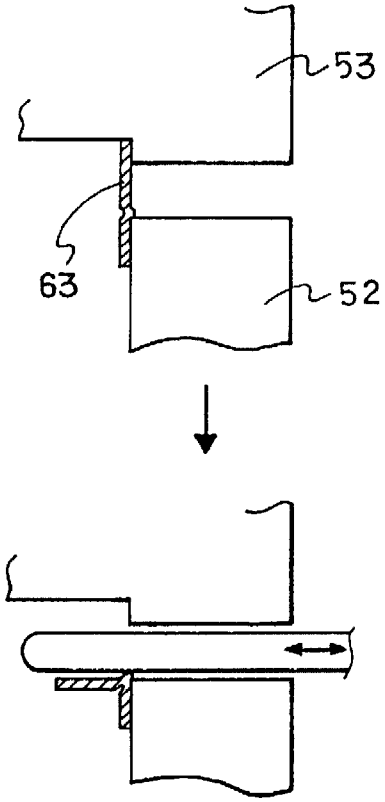

The leaf spring 63 shown in FIG. 13(A) has its upper portion fixedly mounted on an inner surface of the lid 53, and its lower portion brought into press-contact with an upper inner surface of the container body 52. In contrast with this, the leaf spring 63 shown in FIG. 13(B) has its lower portion fixedly mounted on the upper inner surface of the container body 52, and its upper portion brought into press-contact with the inner surface of the lid 53.

Figure 13C:
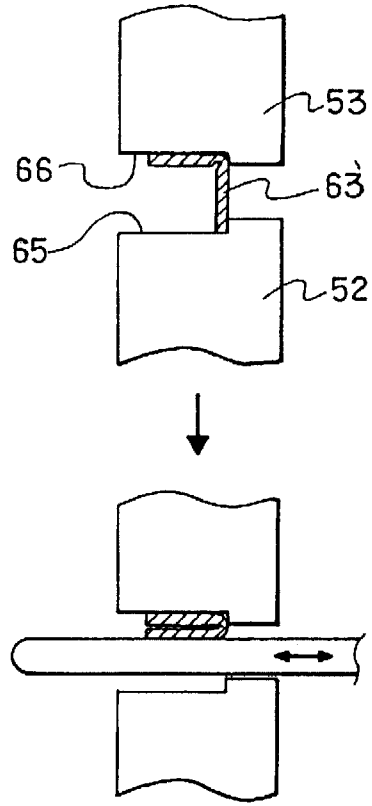
Figure 13D:
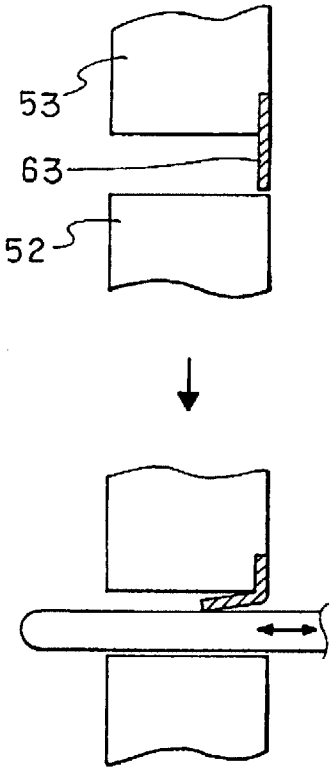

In the case of FIG. 13(C), shoulder portions 65 and 66 are formed in abutting surfaces of the container body 52 and the lid 53, respectively. A half of the leaf spring 63 is fixedly mounted on a horizontal surface of one of the shoulder portions 65, 66, which one is the shoulder portion 66 in FIG. 13(C). The remaining half of the leaf spring 63 is brought into press-contact with a vertical surface of one of the shoulder portions 65, 66, which one is the shoulder portion 65 in FIG. 13(C). On the other hand, the leaf spring 63 shown in FIG. 13(D) is fixedly mounted on the lid 53 in an outside of the nozzle insertion port 62. The half of the leaf spring 63 may be fixed to one of the container body 52 or the lid 53, while the other half of the leaf spring 63 may be disposed close to one of the container body 52 and the lid 53 without contacting it which one is the container body 52 in FIG. 13(D).

Figure 14:
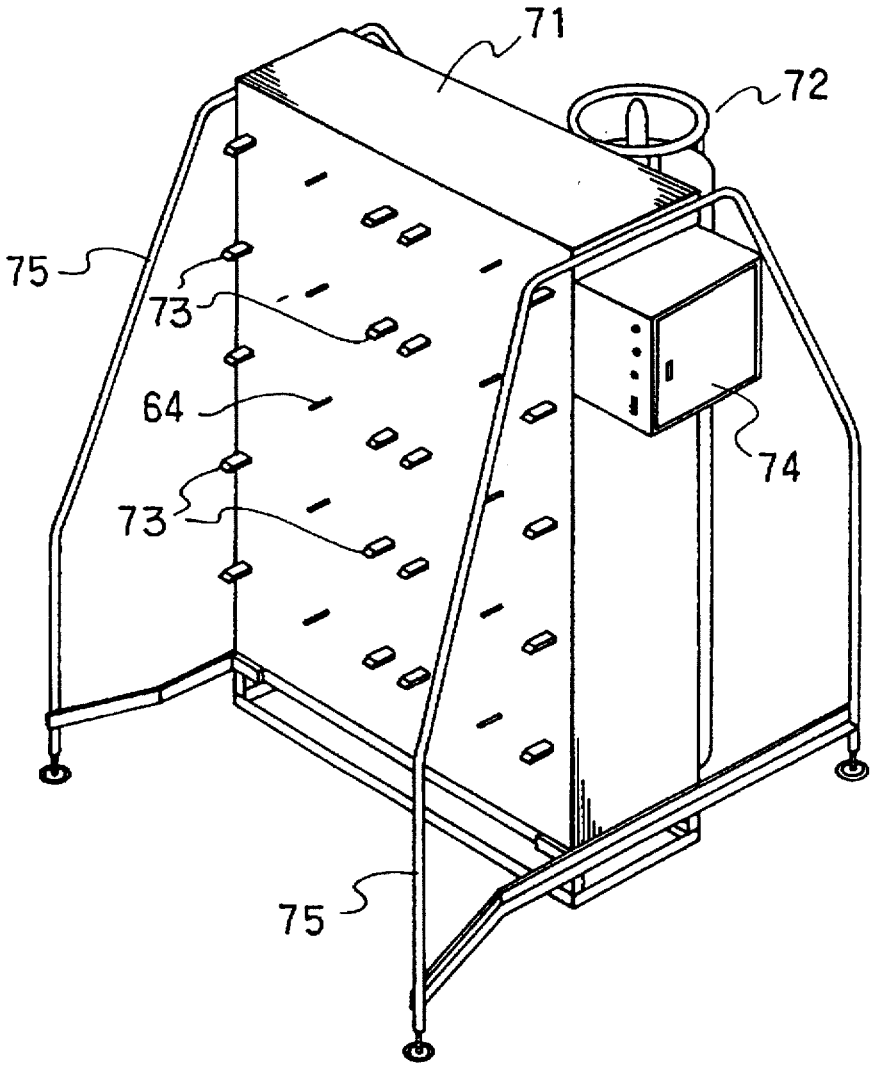
FIG. 14 is a perspective view of the liquefied-gas supply unit for supplying a liquefied gas to the foamed plastic container shown in FIG. 11.

Shown in FIG. 14 is a container cooling unit 71 for supplying the liquefied gas to the liquefied-gas supply area 58 which is defined above the snow support 57 in the foamed container 51. The container cooing unit 71 has five horizontal rows and two vertical column so as to permit 10 pieces of the foamed containers 51 to be individually supplied with the liquefied gas at once. Of course, the number of the rows and that of the columns in the unit 71 may be arbitrarily changed. The container cooling unit 71 is provided with a high-pressure cylinder 72 in its rear side, the cylinder 72 containing liquid carbon dioxide, liquefied nitrogen and the like. Provided in a front surface of the cooling unit 71 are 10 pieces of the liquefied-gas supply nozzles 64, which are arranged in five horizontal rows and two vertical column to project forward from the front surface of the unit 71. Provided in opposite sides of each of the nozzles 64 are a pair of the lifting members 73 projecting forward from the front surface of the unit 71, the lifting members 73 being already described in the above.

A front end of the lifting member 73 assumes a wedge-type shape, and inserted into a gap between the container body 52 and its lid 53 (in case that the notch 61 is provided, the lifting member 73 has its front end inserted into the notch 61), so that one of the opposite short sides of the lid 53 is slightly lifted relative to the other, whereby the nozzle insertion opening for permitting the nozzle 64 to enter the opening is formed by means of the lower concave portion **54*a* of the container body 52 and the upper concave portion 59 of the lid 53, which makes it possible for the nozzle 64 to supply the liquefied gas to the liquefied-gas supply area 58 in the foamed container 51. In case that the foamed container 51 is provided with the nozzle insertion port 62 as shown in FIGS. 13(A), 13(B) 13(C) and 13(D), it is possible to omit the provision of the lifting members 73**.

A control box 74 is fixedly mounted on a side surface of the container cooling unit 71. A pair of guide frames 75 are fixedly mounted on opposite sides of the cooling unit 71. As shown in FIG. 14, each of the guide frames 75 has its front portion configured so as to flare outwardly, which facilitates entrance of a setting rack or stillage 77 (shown in FIG. 15) into a space defined between the guide frames 75.

Figure 15:
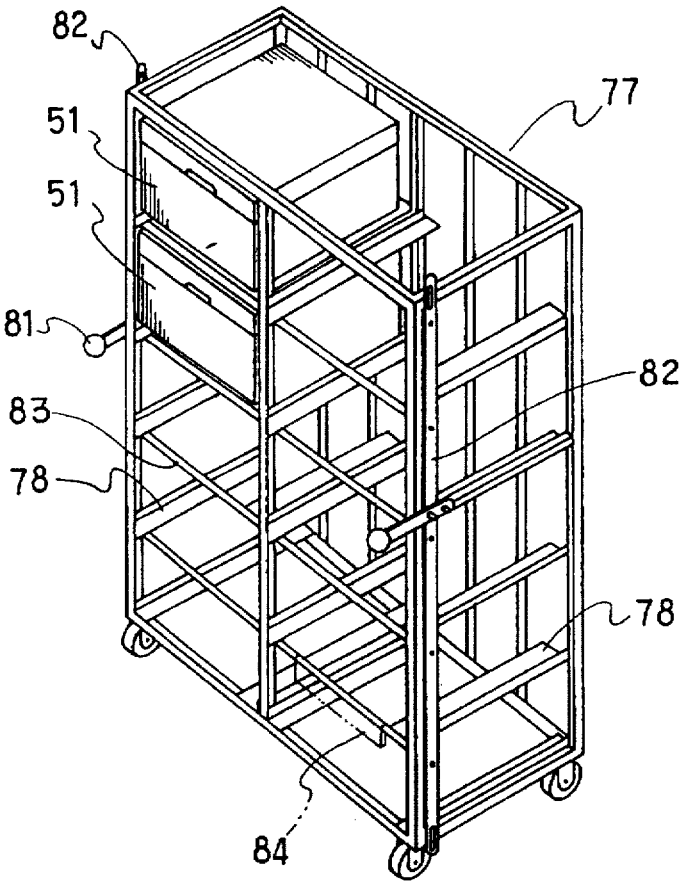
FIG. 15 is a perspective view of a rack-type stillage which is used when the liquefied gas is supplied to the foamed plastic container.

The setting stillage 77 is constructed of a framework provided with a plurality of casters, as shown in FIG. 15. The stillage 77 carries a plurality of the foamed containers 51, and serves to connect the foamed containers with the container cooling unit 71 at once. Further, the setting stillage 77 is an exclusive one which is coupled with the container cooling unit 71 in operation, and provided with a plurality of racks 78 for disposing the foamed containers 51 in positions corresponding to the installation positions of the nozzles 64 and the lifting members 73.

In operation, after the foamed containers 51 are mounted on the racks 78 of the setting stillage 77, the stillage 77 is pushed toward the cooling unit 71 while guided by the guide frames 75 to contact the unit 71, whereby the nozzles 64 are inserted into the individual containers 51. The control box 74 is provided with a temperature setting switch in addition to a main switch. The amount of the liquefied gas to be supplied to the foamed containers 51 is controlled by the use of the control box 74. Through this control operation, it is possible to control each of the nozzles 64 independently.

Part of the liquefied gas thus supplied into the foamed containers 51 is immediately converted into its solid phase on the snow support 57. For example, in case of liquid carbon dioxide, snowy dry ice is produced on the snow support 57. In case that the snow support 57 is gas-permeable, the gas thus supplied passes through the snow support 57 to flow downward in the container 51, so that the interior of the container 51 is immediately cooled. At this time, the air confined in the foamed container 51 is replaced with the thus supplied gas to prevent oxidization of the goods contained in the container 51. Consequently, when the goods comprises perishable foods, it is also possible to prevent such perishable foods from breathing, which also makes it possible to keep the foods fresh. Both the controlled cold and the prevention of breathing of the perishable foods serve to keep the food fresh.

More specifically, vegetables still breathe after their harvest. Due to such breathing, oxygen in the atmosphere combines with carbon in the vegetables to form sugar which is decomposed into various substances. These substances eventually produce water and carbon dioxide. Consequently, the more the breathing of vegetables increases, the more the vegetables lose their freshness. This shortens the effective storage life of vegetables. In summary, as for the breathing action of the vegetables and the temperature to which the vegetables are exposed, a close relationship is recognized therebetween. It is known that when the temperature increases by 10 degrees centigrade, the amount of breathing action is at least doubled.

Vegetables breathe to discharge the resultant products, and, are therefore exhausted with such breathing action. In this breathing action of the vegetables, the atmosphere provides oxygen and receives carbon dioxide and energy discharged from the vegetables. The atmosphere comprises in composition: a 21 percent of oxygen molecule; a 78 percent of nitrogen molecule; a 0.04 percent of carbon dioxide; and, the balance. When part of the percentage of oxygen molecule is replaced with carbon dioxide in the atmosphere to produce a carbon dioxide-rich atmosphere, the breathing action of vegetables is restricted in such carbon dioxide-rich atmosphere. In the present invention, since the carbon dioxide-rich atmosphere is automatically produced in the container 51 after completion of injection of the liquefied gas into the container 51, it is possible to prevent the perishable foods from breathing, which the user to keep the foods fresh for a long period of time. The effective storage life of such perishable foods is further increased when the foods is stored at low temperatures.

As shown in FIG. 15, a pair of levers 81 for moving a pair of drive rods 82 up and down are pivotally mounted on opposite sides of the setting stillage 77, the pair of the drive rods 82 being slidably mounted on the same opposite sides of the setting stillage 77 so as to be movable up and down. The levers 81 are used to return the lids 53 of the foamed containers 51 to their initial positions, one of the opposite short sides of the lids 53 having been lifted for facilitating the supplying operation of the liquefied gas to the container 51. More specifically, provided between the drive rods 82 is a push-down bar 83. In operation, when the levers 81 are swingably moved downward, the push-down bar 83 is moved downward through the drive rods 82 so that the lids 53 are depressed by the bar 83. After completion of this push-down operation, the levers 81 are swingably moved upward to return to their initial positions, so that the push-down bar 83 is also moved upward to return its initial position.

Figure 16:
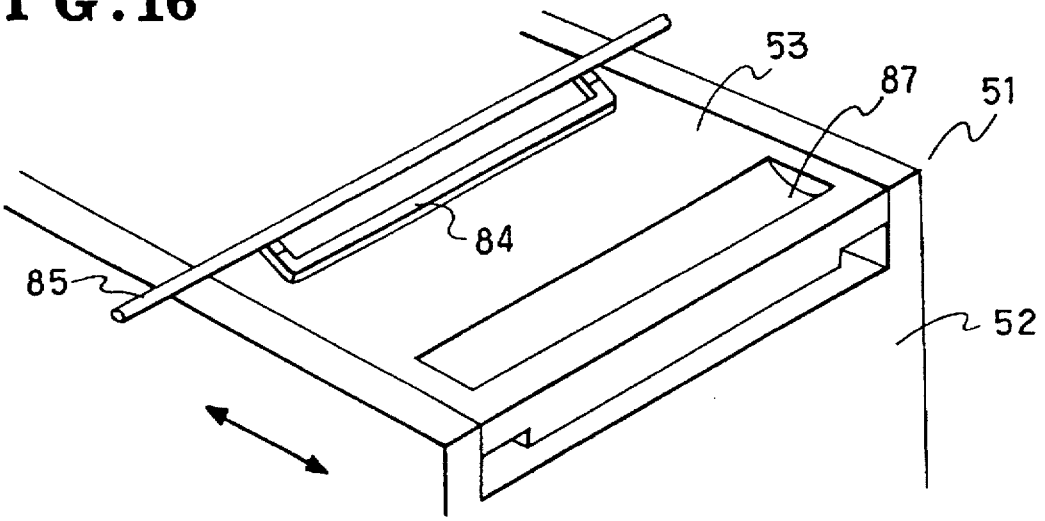
FIG. 16 is a perspective view of an automatic lid closing mechanism in the stillage shown in FIG. 15.

As shown in FIG. 16, the setting stillage 77 may be provided with a lid-depressing member 84, instead of the provision of the above-described lid-depressing mechanism, or, together with the provision of the same. The lid-depressing member 84 is horizontally disposed and rotatably provided so as to be suspended from a rotary shaft 85, and assumes a single elongated rod-like shape. It is also possible to provide a plurality of the lid-depressing members 84 in parallel with each other with respect to a single piece of the rotary shaft 85. On the other hand, as shown in FIGS. 16 and 17(A), 17(B), 17(C), 17(D) and 17(E), an axial groove 87 is formed in an end portion of the lid 53 of the foamed container 51 to extend in a direction parallel to an axial direction of the rotary shaft 85. The axial groove 87 gradually increases in depth toward the longitudinal end of the lid 53.

Now, the lid-depressing member 84 will be described in action with reference to FIGS. 17(A), 17(B), 17(C), 17(D) and 17(E).

Figure 17A:
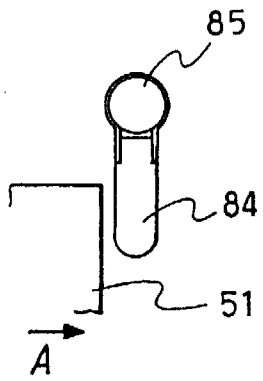
FIGS. 17(A), 17(B), 17(C), 17(D) and (17E) are sectional views of the automatic lid closing mechanism shown in FIG. 16, illustrating the operation thereof.
Figure 17B:
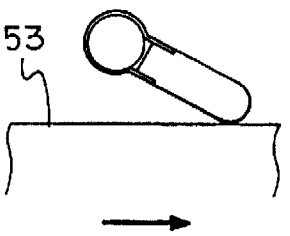
Figure 17C:
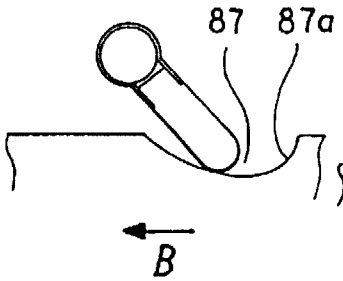
Figure 17D:
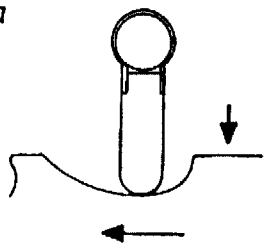
Figure 17E:
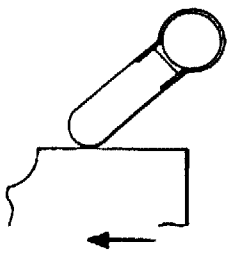

When the foamed container 51 is pushed onto the rack of the setting stillage 77 in the direction of the arrow "A", the lid-depressing member 84 is pushed by the foamed container 51 to rotate counterclockwise as viewed in the drawings, so that the member 84 substantially extends along the upper surface of the lid 53, as shown in FIG. 17(B). When the foamed container 51 is pulled forward in the direction of the arrow "B" to remove it from the rack of the setting stillage 77, the lid-depressing member 84 swingably moves downward to contact with the groove 87, as shown in FIG. 17(C). When the foamed container 51 is further pulled forward, the lid-depressing member 84 is brought into contact with an end portion 87*a* of the groove 87 and swingably moved forward (i.e., rotated clockwise). At this time, since the rotary shaft 85 stays in its initial position, the lid 53 is depressed by the lid-depressing member 84, as shown in FIG. 17(D). As a result, the lid 53 returns to its initial position to close the foamed container 51 therewith. When the foamed container 51 is still further pulled forward, the lid-depressing member 84 keeps on rotating clockwise, and, therefore escapes from the groove 87, as shown in FIG. 17(E).

Figure 27:
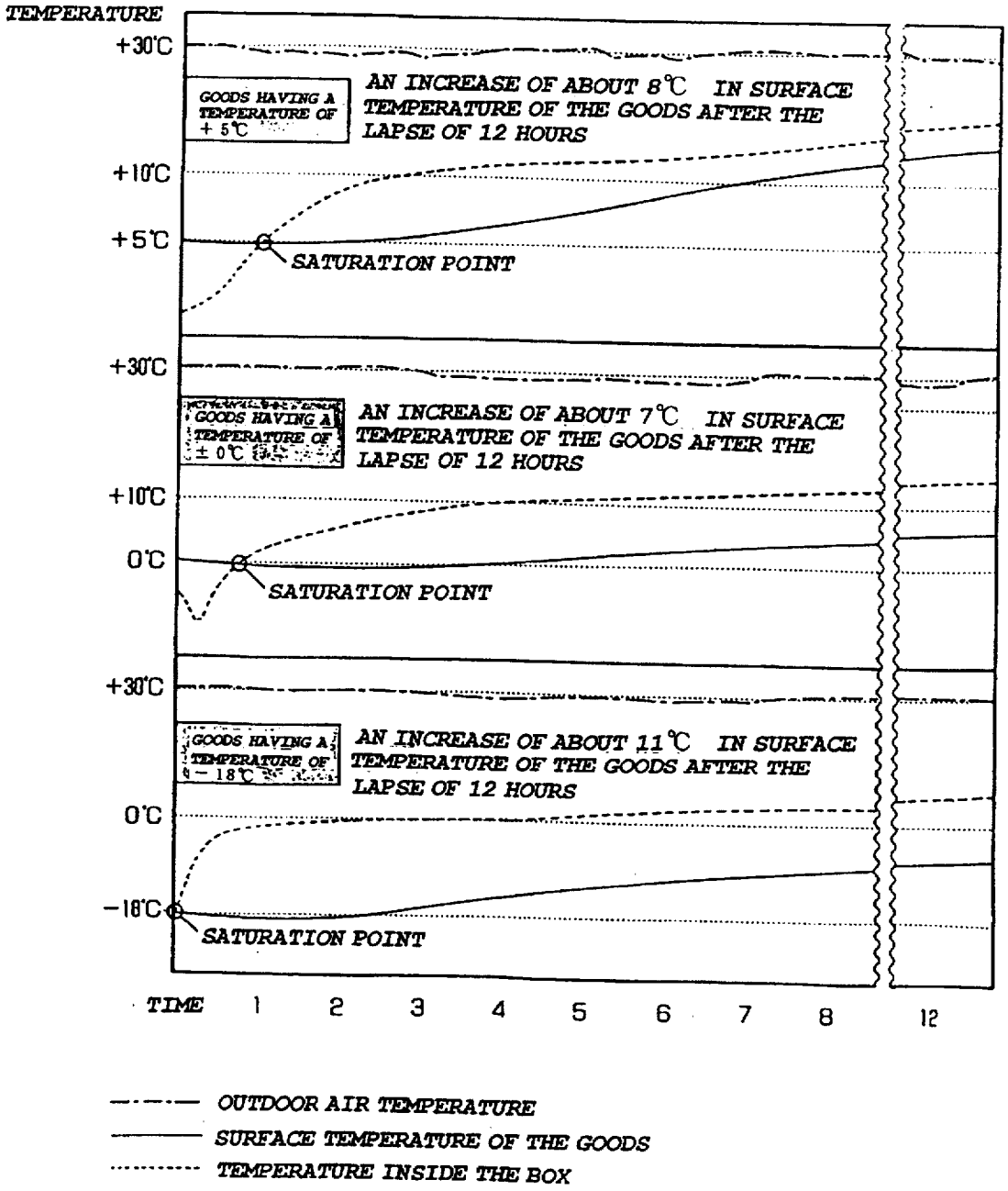
FIG. 27 is a graph showing temperature variations (with elapsed time for 12 hours) in: the interior of the foamed plastic container; a surface of the goods; and, outdoor air.

Shown in FIG. 27 is a graph illustrating, in a concrete manner, the data of temperature variations in the foamed container 51 provided with the mesh-type snow support. The data relates to temperature variations of each of the goods: the first one of the goods having a surface temperature of +5 degrees centigrade; the second one having a surface temperature of plus/minus 0 degree centigrade; and, the third one having a surface temperature of −18 degrees centigrade. The graph represents temperature variations (with elapsed time for 12 hours) of the outdoor air, the surface of the goods, and the interior of the foamed container 51. According to the graph, after completion of the supplying operation of liquid carbon dioxide to the foamed container 51 containing the goods, the goods of the surface temperature of +5 degrees centigrade reaches the saturation point in approximately one hour. On the other hand, the goods of the surface temperature of plus/minus 0 degree centigrade reaches the saturation point in approximately 40 minutes. The remaining goods of the surface temperature of −18 degrees centigrade immediately reaches the saturation point. After that, any of the goods show no considerable variation in surface temperature. After a lapse of 12 hours: the increase in surface temperature of the goods of the surface temperature of +5 degrees centigrade is approximately 8 degrees centigrade only; that of the goods of the surface temperature of plus/minus 0 degree centigrade is approximately 7 degrees centigrade only; and, that of the remaining goods of the surface temperature of −18 degrees centigrade is approximately 11 degrees centigrade only. In any case, such increases in surface temperature of the goods do not affect the goods in quality. Consequently, the foamed container 51, which carries out the present invention, makes it possible for the user to properly control the chilled goods in temperature so as to facilitate transportation and storage of the goods.

Figure 18:
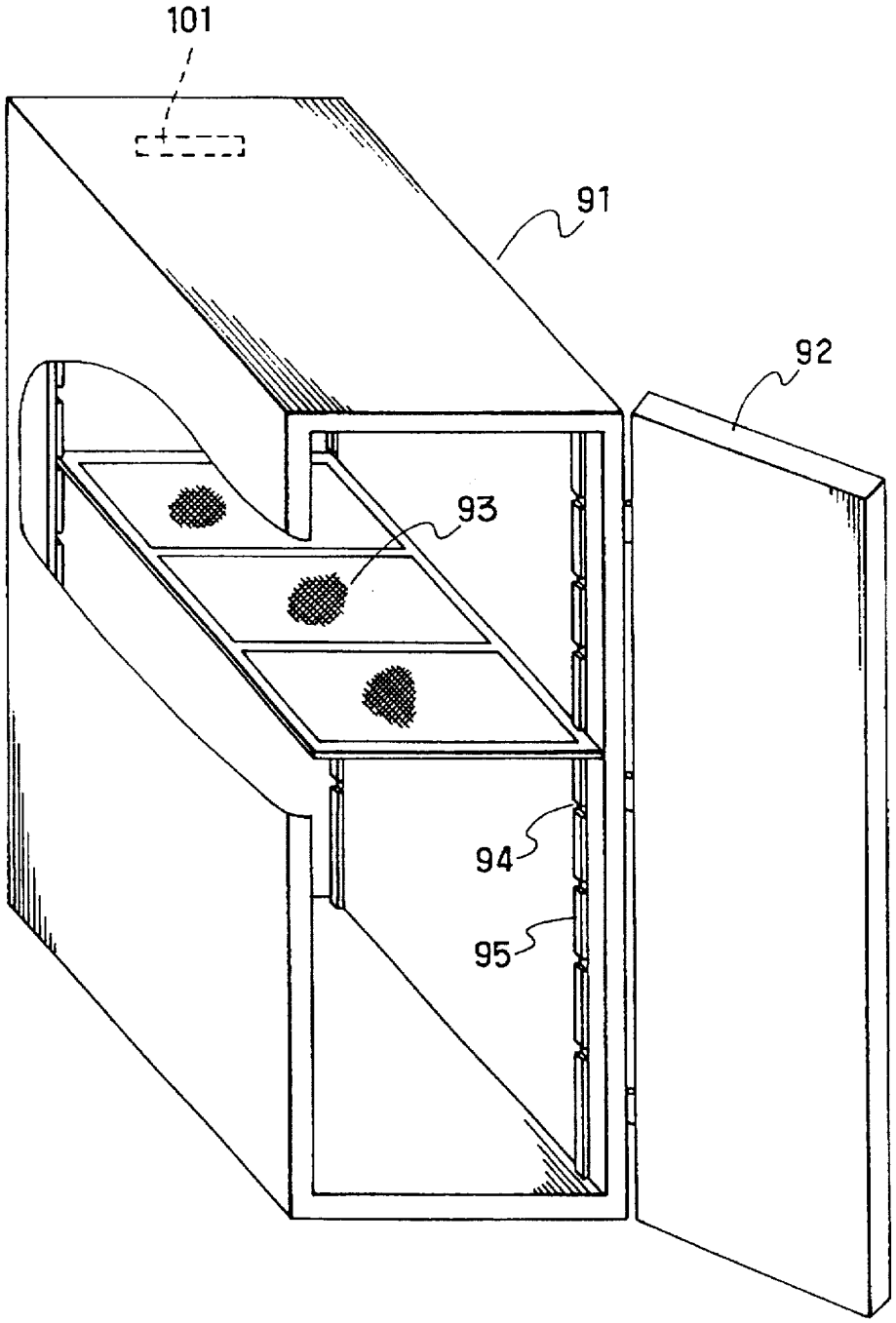
FIG. 18 is a partially broken perspective view of a hard container for carrying out the method of the present invention.
Figure 19:
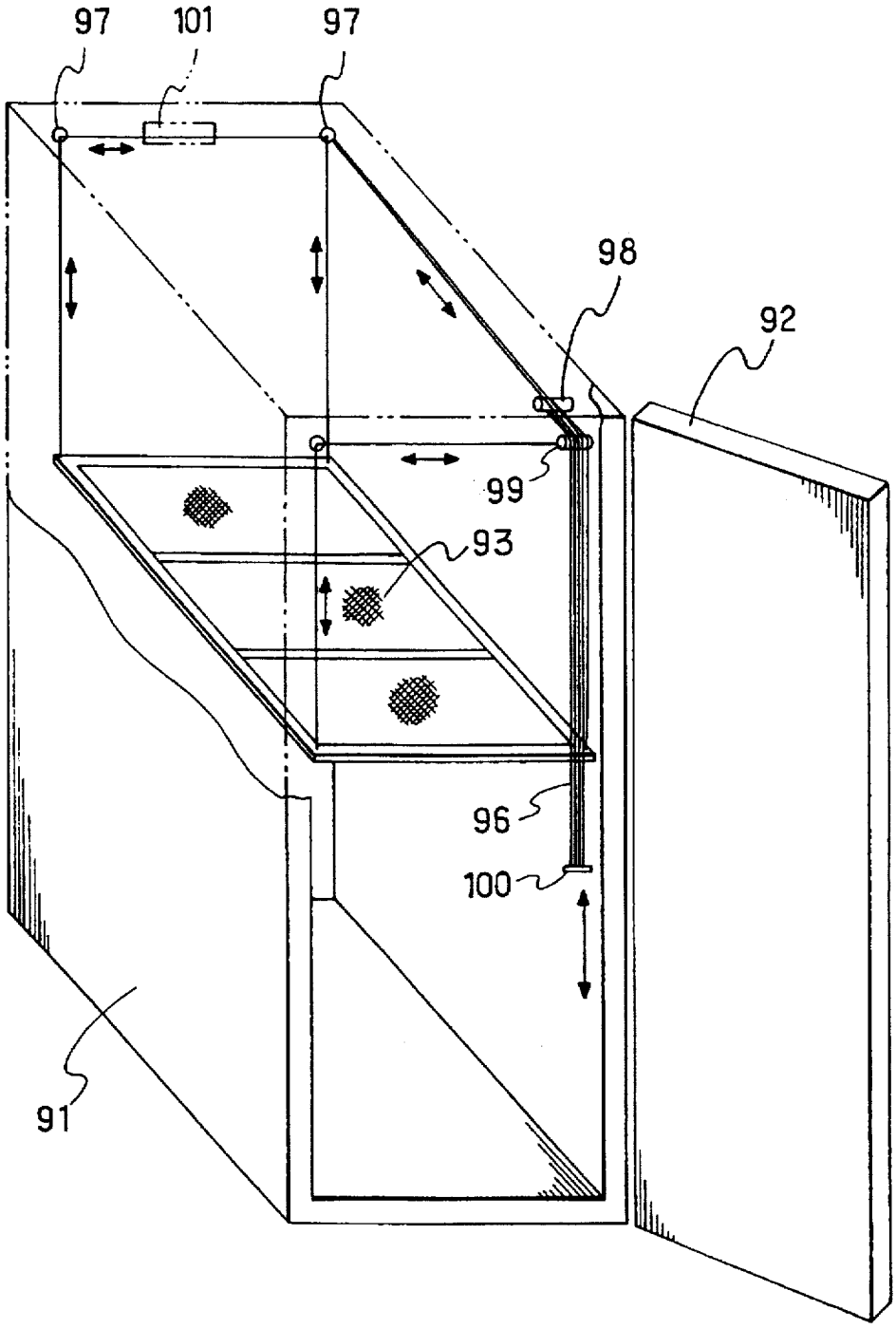
FIG. 19 is a partially broken perspective view of another embodiment of the hard container shown in FIG. 18.

Shown in FIGS. 18 and 19 is a hard container 91, which is generally called the hard case or the hard box, and has the substantially same size as that of a domestic refrigerator. The hard container 91 is tough in construction, thermally insulated, and generally provided with a plurality of casters. The hard container 91 is provided with a door 92 in each of its front and rear surfaces, and also provided with the snow support 93 in its interior. The snow support 93 is made of or constructed of the substantially same material or member as those of the snow support 57 used in the preceding embodiment. The door 92 may be provided with a glazed window, which covers the entire or a part of the front or the rear surface of the hard container 91 to enable the user to check the interior of the container 91. Preferably, the snow support 93 is made adjustable in its mounting position stepwise or in a stepless manner, which makes it possible for the snow support 93 to change its mounting position so as to save the space being cooled according to the volume of the goods. In the embodiment of the hard container 91 shown in FIG. 18, a plurality of pairs of insertion slots 94 are provided in opposite inner surfaces of the container 91 so as to be spaced apart from each other at predetermined intervals. Defined between vertically-adjacent ones of the insertion slots 94 is a rack support 95. In this embodiment shown in FIG. 18, the snow support 93 may be pulled out of the hard container 91 when the door 92 is opened, and, therefore may be inserted into a desired pair of the insertion slots 94 to change its mounting level or height.

In another embodiment of the hard container 91 shown in FIG. 19, the snow support 93 has its four corners suspended on four wires 96 and the like from an upper inner surface of the container 91. The four wires 96 pass through rings 97, meet each other at a guide roller 98, pass through a stopper 99, and have their front ends fixed to a grip bar 100. The stopper 99 is constructed of a plurality of double-cone type pulleys, which are coaxially arranged side by side as is clear from FIG. 19. Each of the wires 96 runs between adjacent ones of these double-cone type pulleys of the stopper 99. When the user pulls down the wires 96 by means of the grip bar 100, the wires 96 are firmly sandwiched between the adjacent double-cone type pulleys of the stopper 99, which makes it possible to hold the snow support 93 in a desired position. When the user wants to change the position of the snow support 93, it suffices to simply move the suspended free-end portions of the wires 96 from their vertical positions (shown in FIG. 19) to their horizontal positions, which releases the wires 96 from the stopper 99.

A liquefied-gas supply elongated port 101 is formed in any one of the side surfaces of the hard container 91, door 92 and the ceiling portion of the container 91. In case of the embodiment shown in FIG. 19, the elongated port 101 is formed in the side surface of the container 91 to extend horizontally. The port 101 is provided with an port-cover means such as the leaf spring 63 shown in FIGS. 13(A)–13(D). Namely, the port-cover means is resiliently bent inwardly when pushed inwardly, so that the port 101 is opened.

Figure 28:
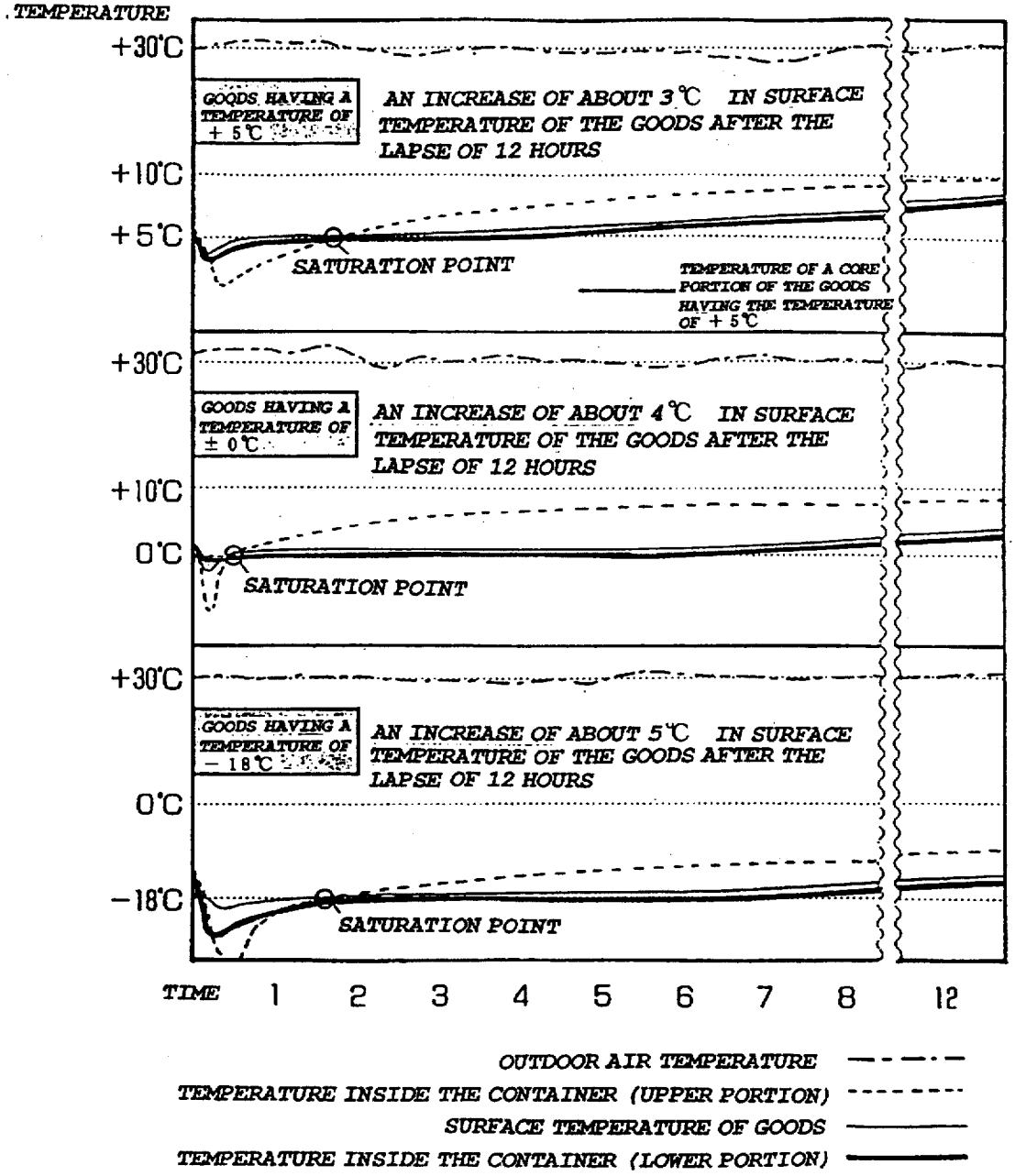
FIG. 28 is a graph showing temperature variations (with elapsed time for 12 hours) in: an upper and a lower portion of the hard container carrying out the method of the present invention; a surface of the goods; and, outdoor air.

Shown in FIG. 28 is a graph illustrating, in a concrete manner, the data of temperature variations in the hard container 91 provided with the mesh-type snow support. The data relates to temperature variations of each of the goods: the first one of the goods having a surface temperature of +5 degrees centigrade; the second one having a surface temperature of plus/minus 0 degree centigrade; and, the third one having a surface temperature of −18 degrees centigrade. The graph represents temperature variations (with elapsed time for 12 hours) of the outdoor air, the surface of the goods, an upper and a lower portion of the interior of the hard container 91. According to the graph, after completion of the supplying operation of liquid carbon dioxide to the hard container 91 containing the goods, the goods of the surface temperature of +5 degrees centigrade reaches the saturation point in approximately one hour. On the other hand, the goods of the surface temperature of plus/minus 0 degree centigrade reaches the saturation point in approximately 30 minutes. The remaining goods of the surface temperature of −18 degrees centigrade reaches the saturation point in one and half hours. After that, any of the goods show no considerable variation in surface temperature. After a lapse of 12 hours: the increase in surface temperature of the goods of the surface temperature of +5 degrees centigrade is approximately 3 degrees centigrade only; that of the goods of the surface temperature of plus/minus 0 degree centigrade is approximately 4 degrees centigrade only; and, that of the remaining goods of the surface temperature of −18 degrees centigrade is approximately 5 degrees centigrade only. In any case, such increases in surface temperature of the goods do not affect the goods in quality. Consequently, the hard container 91, which carries out the present invention, makes it possible for the user to properly control the chilled goods in temperature so as to facilitate transportation and storage of the goods.

Figure 20:
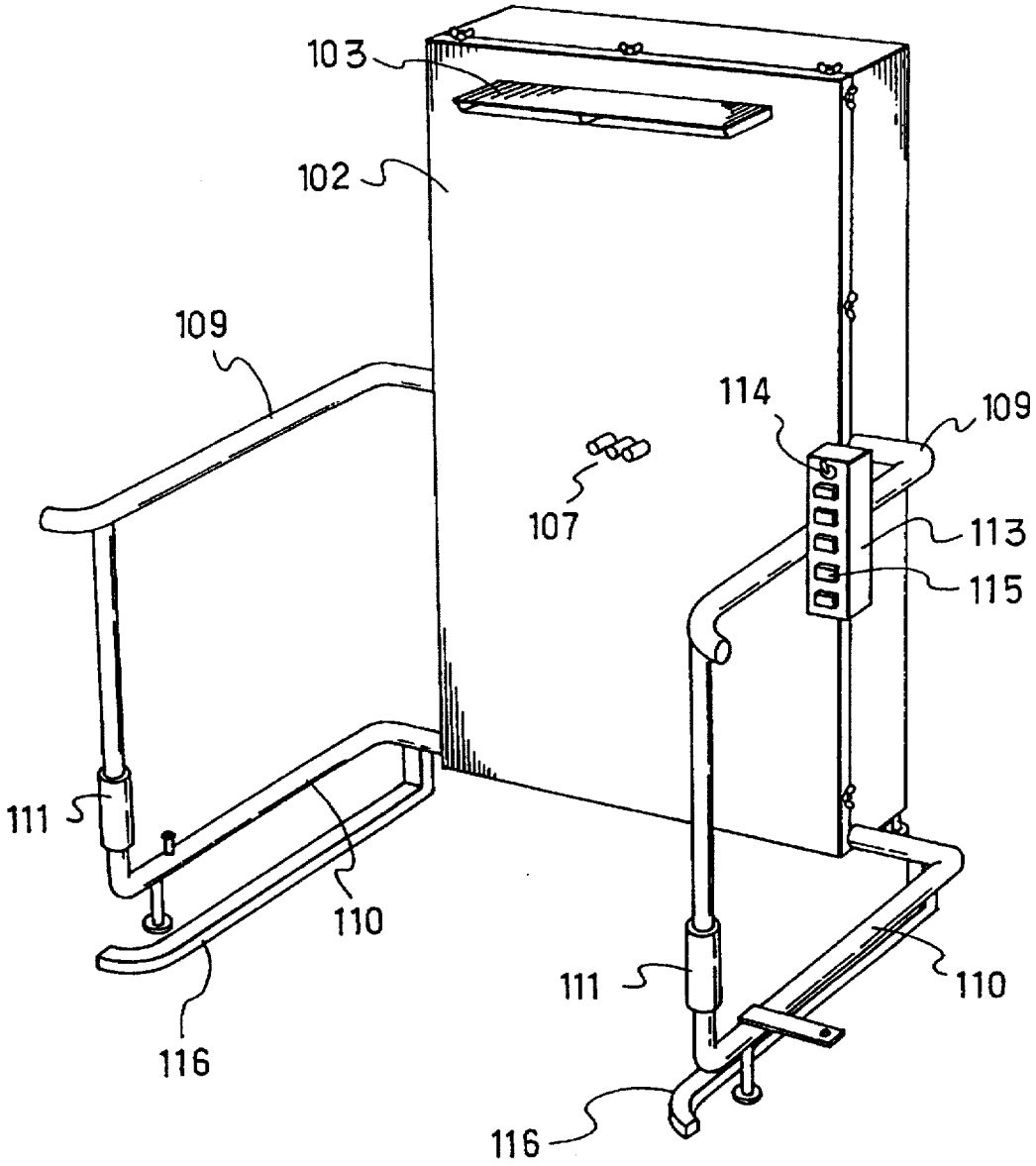
FIG. 20 is a perspective view of the liquefied-gas supply unit for supplying the liquefied gas to the hard container shown in FIG. 18.

Shown in FIG. 20 is a container cooling unit 102 for supplying the liquefied gas to the hard container 91. Detachably mounted on the container cooing unit 102 is a high-pressure cylinder containing the liquefied gas such as liquefied nitrogen, liquid carbon dioxide and like liquefied cooling gases. Provided in a front upper surface of the cooling unit 102 is the liquefied-gas supply nozzle 103 assuming a horizontally-extending flat shape. The nozzle 103 projects forward from the front surface of the container cooling unit 102. The liquefied-gas supplying operation to the hard container 91 is performed by inserting the nozzle 103 into the liquefied-gas supply port 101 of the container 91. When the liquefied gas is supplied to the container 91, the interior of the container 91 is rapidly cooled. The nozzle 103 is not limited in shape to one shown in FIG. 20, and may assume any desirable shape.

Figure 21:
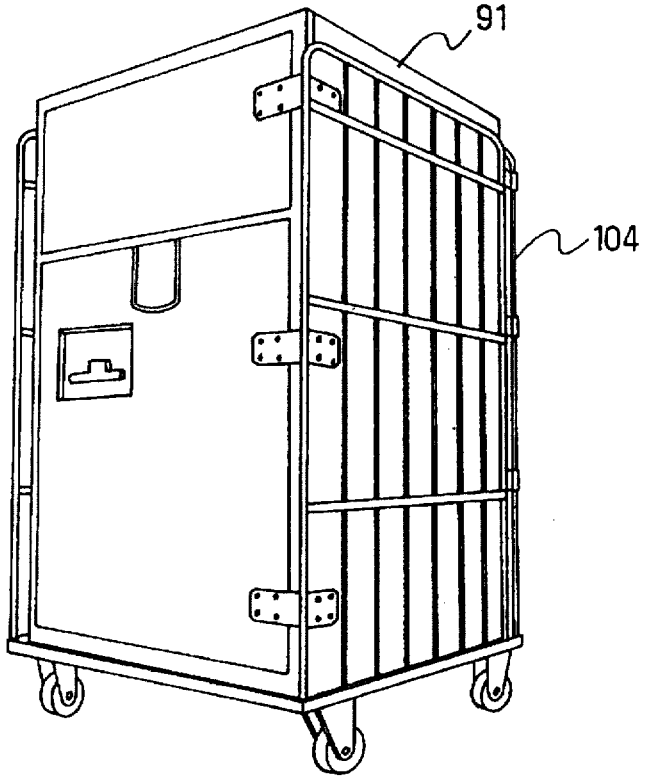
FIGS. 21 and 22 are perspective views of a cage-type stillage which is used when the liquefied gas is supplied to the hard container shown in FIG. 18.
Figure 22:
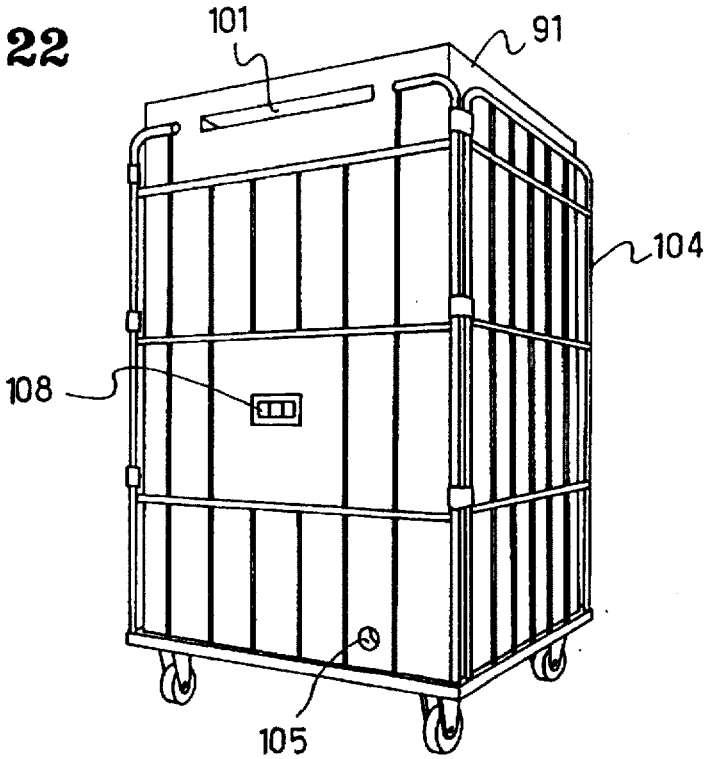

In coupling operation of the hard container 91 with the cooling unit 103, the hard container 91 is often mounted on a carrier called the cage-type stillage 104 (shown in FIGS. 21 and 22).

The hard container 91 has the facility for automatically setting a temperature of its interior at a predetermined temperature range. Namely, provided in a front surface of the cooling unit 102 abutting against the hard container 91 is a temperature-range setting switch 107 for selecting any one of three temperature ranges: a first one is a cool range; a second one is a chilled range; and, a third one is a freeze range. On the other hand, as shown in FIG. 22, a selection switch 108 for selectively turning on the temperature-range setting switch 107 is provided in a rear surface of the hard container 91. The selection switch 108 is of any one of a push type, slide type and the like, and is preset at a predetermined temperature range in shipping. It is also possible to use such selection switch in the foamed container 51, provided that the selection switch used in the foamed container 51 is of a simple removable type since the foamed container 51 is not repeatedly used.

As shown in FIG. 20, a pair of upper guide frames 109 are fixedly mounted on substantially intermediate portions of opposite side walls of the cooling unit 102. As is clear from FIG. 20, each of the guide frames 109 has its front-end portion configured so as to flare outwardly, which facilitates entrance of the hard container 91 (shown in FIG. 19) into a space defined between the guide frames 109. Further, a pair of lower guide frames 110 are fixedly mounted on lower portions of the opposite side walls of the cooling unit 102. As is clear from FIG. 20, each of the lower guide frames 110 has its front-end portion configured so as to flare outwardly, which facilitates entrance of the hard container 91 (shown in FIG. 19) into a space defined between the lower guide frames 110. These lower guide frames 110 have upper ends of their vertical portions connected with the upper guide frames 109. Free rolls 111 made of plastics, rubber and like materials are rotatably mounted on the vertical portions of the lower guide frames 110.

In FIG. 20, the reference numeral 113 denotes a switch box comprising a power switch 114, an on/off indicator, a display portion 115 for displaying the temperature range which one is set by operating the temperature-range setting switch. The switch box 113 is mounted on a desirable portion of the cooling unit 102. Further, it is also possible to provide a pair of rails 116 (which extend in parallel to each other) under the cooling unit 102, the rails 116 guiding the hard container 91 or the cage-type stillage 116. Each of the front-end portions of the rails 116 is so configured as to flare outwardly, which facilitates entrance of the hard container 91 (shown in FIG. 19) and the like into a space defined between the guide frames 109, 110.

The hard container 91 or the cage-type stillage 104 is pushed to properly move along the rails 116, and finally abuts against the front surface of the cooling unit 102, so that the nozzle 103 enters the liquefied-gas supply port 101. At this time, by means of the selection switch, the temperature-range setting switch is selectively depressed, so that the liquefied gas is supplied to the hard container 91 for a predetermined period of time, or by a predetermined amount of the liquefied gas.

Figure 23:
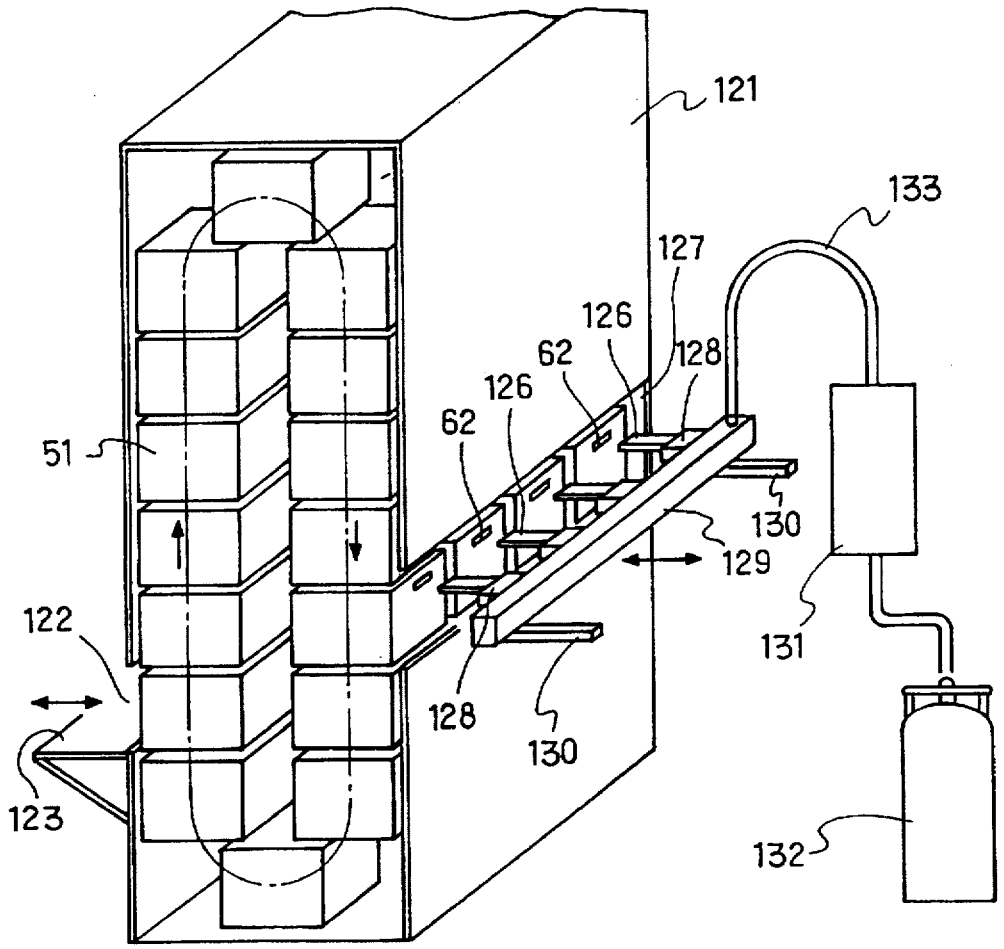
FIG. 23 is a partially broken perspective view of an embodiment of an automatic warehouse for carrying out the method of the present invention.
Figure 24:
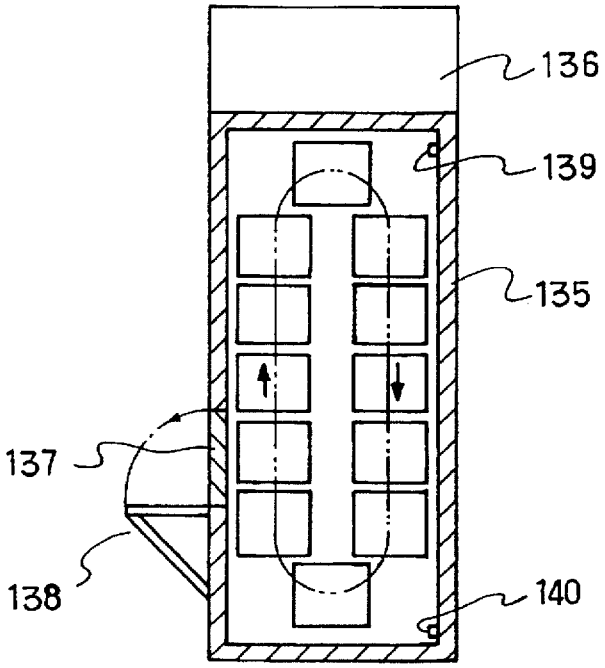
FIG. 24 is a side view of another embodiment of the automatic warehouse shown in FIG. 23, illustrating its schematic construction.
Figure 25:
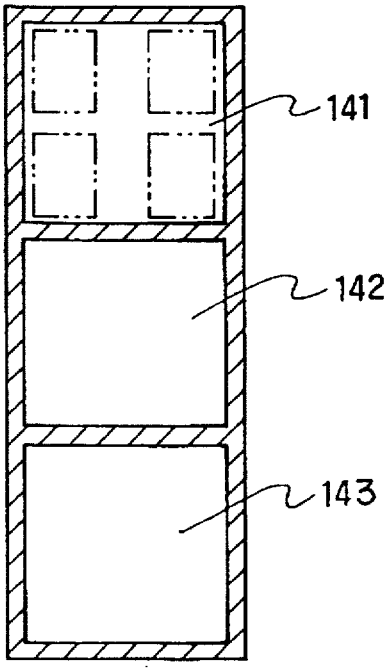
FIG. 25 is a plan view of a multiple automatic warehouse which is a modification of the automatic warehouse shown in FIG. 23.

Shown in FIGS. 23 to 25 are embodiments of an automatic warehouse having automatic circulating storage functions, to which the method of the present invention is applied.

First, the embodiment shown in FIG. 23 will be described. Shown in FIG. 23 is an automatic space warehouse constructed of a vertical-type automatically circulating rack system. In such rack system, a plurality of racks (not shown) are housed in a storage room 121 and vertically circulated therein. Provided in a front side (i.e., a left-side surface as viewed in FIG. 23) of the storage room 121 is the entrance/exit 122 to the room 121, through which 122 the containers enter the room 12. As is clear from FIG. 23, the entrance/exit 122 is the substantially same in width as the front side of the storage room 121. A working bench 123 is installed in the same height as that of the entrance/exit 122 of the storage room 121.

In case of the foamed container 51, it is pushed in the storage room 121 through the entrance/exit 122 while carried on the working bench 123, and then put on the rack (not shown). In the embodiment shown in FIG. 25, 4 pieces of the foamed containers 51 are disposed side by side with each other on one of the racks. In this connection, it is preferable to provide a partition in the rack so as to neatly dispose the individual foamed containers 51 in their predetermined positions.

A rear opening portion 127 is formed in a rear surface (i.e., a right-side surface as viewed in FIG. 23) of the storage room 121 to extend the entire width of the storage room 121 for receiving the cooling unit. Through the rear opening portion 127, the foamed containers 51 carried on the same rack have their rear surfaces exposed to the cooling unit.

The liquefied-gas injection or supply nozzle 126 is connected with a nozzle holder 129 through an electromagnetic valve 128. The nozzle holder 129 is so constructed as to automatically travel in a horizontal direction along a pair of rails 130. The nozzle holder 129 is a hollow member connected with a gas tubing 133 through a control portion 131. The tubing 1133 extends from the high-pressure cylinder 132 of the liquefied gas.

In the above construction, in order to store the foamed container 51, when the container 51 is transferred from the entrance/exit 122 of the storage room 121 to one of the racks, the racks move intermittently by a distance substantially equal to a space between adjacent ones of the racks, the distance or the space being hereinafter referred to as a pitch of the racks. The nozzle holder 129 moves forward while the racks stop their motion (in general, the nozzle holder 129 is driven by a pneumatic cylinder), so that the individual liquefied-gas supply nozzles 126 enter the containers 51 through their nozzle insertion ports 62 exposed to the cooling unit.

Then, the temperature of the interior of the container is checked by the means of the temperature sensor. As for the container 51 having been determined to exceed in its interior temperature a predetermined value, the electromagnetic valve 128 is actuated so that the liquefied gas supplied from a liquefied-gas reservoir 132 is injected from the liquefied-gas supply nozzle 126, whereby the interior of the container is coolede when the temperature of the interior of the container is below the predetermined value, the electromagnetic valve 128 corresponding to such container is not actuated so that the liquefied gas is also not supplied to such container.

After completion of the above operation, the nozzle holder 129 is temporarily moved back when the rack is moved by one pitch. As a result, the foamed containers 51 carried on a subsequent one of the racks appear in the rear opening portion 127 of the storage room 121. After that, the same operation described above is repeated. After completion of one cycle of the circulation of the racks, the racks stop their motion. After that, in case that transfer and shipping operations of the foamed containers 51 are not conducted for a long period of time, preferably, automatic checking operations are conducted at predetermined time intervals, so that the temperature of the containers stored in the storage room 121 is properly controlled.

Shown in FIGS. 24 and 25 are embodiments in which the foamed containers 51 are not used. In these embodiments, the storage room 135 is entirely covered with a heat insulation material to form a hermetically-sealed cooling room, and provided with a cooling means 136 for supplying the liquefied gas. Although there is not shown in FIGS. 24 and 25, a suitable snow support for receiving the liquefied gas thus supplied is mounted on an inner upper portion of the storage room 135. Also provided in the interior of the storage room 135 is a vertical-type automatically circulating rack system, which has the substantially same construction as that of one shown in FIG. 23. Further, the storage room 135 is provided with a hermetically-sealing door 137 and a working bench 138. In the embodiments shown in FIGS. 24 and 25, the chilled goods is directly received in a bucket in their bare state, and carried on the circulating rack without being packaged, or with a suitable packaging such as cartons and the like.

In this case, temperature sensors 139, 140 are mounted in the storage room 135 at suitable positions, for example such as: an upper and a lower portion of the room 135; the upper portion and an intermediate portion of the room 135; the intermediate and the lower portion of the room 135; the upper/lower portions and the intermediate portion of the room 1; and, only the intermediate portion of the room 135. The temperature sensors 139, 140 serve to make the temperature of the interior of the storage room 135 uniform. Since the cold air is accumulated in the bottom of the storage room 135 when the air confined in the storage room 135 is not stirred, the lower portion of the room 135 is sufficiently cooled. On the other hand, the upper portion of the room 135 is also sufficiently or often excessively cooled since the upper portion of the storage room 135 is directly subjected to the liquefied gas thus injected into the storage room 135. In contrast with this, the intermediate portion of the storage room 135 is not sufficiently cooled with the liquefied gas thus supplied. In order to solve the above problem, according to the present invention, the temperature of the interior of the storage room 135 is detected by the use of the temperature sensors 139, 140, and automatically circulates the circulating rack system when the thus detected temperatures exceed predetermined values.

For example, in case that the temperature sensors 139, 140 are disposed in the upper and the intermediate portion of the storage room 135 or disposed in the intermediate and the lower portion of the room 135, when a temperature difference between the temperatures detected by these sensors 139 and 140 exceeds a predetermined value, the circulating rack system is automatically operated to prevent the goods from being excessively cooled or from suffering from lack of the cooling gas. When additional goods is received in the storage room 135, preferably, such additional goods is moved to the uppermost or the lowermost position of the circulating rack system by automatically operating the rack system.

Incidentally, it is also possible to conduct a timer control, instead of the above control conducted by the temperature sensors, through which timer control the circulating rack system is automatically operated at predetermined time intervals so as to change the positions of the racks.

Of course, the circulating rack system may be constantly circulated.

Shown in cross-section in FIG. 25 is an embodiment in which a plurality of the automatic warehouses are connected in series with each other. The number of the warehouses in this embodiment is three. For example, in the embodiment, it is possible to independently control in temperature the storage rooms 141, 142 and 143, so that: the storage room 141 is for cool goods; the storage room 142 for the chilled goods; and, the storage room 143 for the frozen goods.

The foregoing description of the specific embodiments will so fully reveal the general nature of the present invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A vehicle for transporting chilled goods at a low temperature, comprising a thermally-insulated box-type freight compartment which is provided with a many for access and a liquefied-gas supply area in its ceiling portion, said liquefied-gas supply area having its bottom and side surface constructed of one of a gas-permeable material and a gas-impermeable thin material, said freight compartment being further provided with a liquefied-gas supply port in an upper portion of a side surface thereof, which supply port opening into said liquefied-gas supply area is opened when pressed against said freight compartment from the outside thereof under the influence of an external force, and is closed when released from said external force.

2. The vehicle for transporting the chilled goods, as set forth in claim 1, wherein:

said liquefied-gas supply area has its interior divided by partitions into a plurality of chambers.

3. The vehicle for transporting the chilled goods, as set forth in claim 1, wherein:

at least one curtain is suspended from a bottom surface of said liquefied-gas supply area so as to permit said curtain to move back and forth relative to a door of said freight compartment.

4. The vehicle for transporting the chilled goods, as set forth in claim 1, wherein:

said liquefied-gas supply area is constructed of a plurality of independent chambers.

5. The vehicle as set forth in claim 1, wherein the gas-permeable material comprises at least one of perforated panels, mesh members, and net members.

6. The vehicle as set forth in claim 1, wherein the impermeable thin material comprises at least one of aluminum foil, synthetic resin sheet, sheet metal, and non-woven fabrics.

7. A foamed plastic container used for chilled goods, comprising a foamed-plastic container body and a foamed-plastic lid which is hollow to form a liquefied gas supply area and including a snow supporter in bottom and side surface thereof, said snow supporter being constructed or one of a gas-permeable material and a gas-impermeable thin material, said container body and said lid including a liquefied gas supply port into which a nozzle for supplying a liquefied gas to said liquefied gas supply area is inserted.

8. The container as set forth in claim 7, wherein the gas-permeable material comprises at least one of perforated panels, mesh members, and net members.

9. The container as set forth in claim 7, wherein the impermeable thin material comprises at least one of aluminum foil, synthetic resin sheet, sheet metal, and non-woven fabrics.

10. A hard container used for chilled goods, constructed of a heat-insulating hard material wherein:

said container includes a snow supporter in an upper portion thereof to form a liquefied gas supply area on said snow supporter, said snow supporter being constructed of one of a gas-permeable material and a gas-impermeable thin material, said liquefied gas supply area including a liquefied gas supply port into which a nozzle for supplying a liquefied gas to said liquefied gas supply area is inserted, said liquefied gas supply port being higher in an installation position than said snow supporter.

11. The hard container used for the chilled goods, as set forth in claim 10, wherein:

said snow supporter is changeable in its installation position.

12. The hard container used for the chilled goods, as set forth in claim 10, wherein:

said hard container is provided with a selecting switch in its side wall, said selecting switch selectively depressing a temperature-zone setting switch of a cooling unit to set a temperature of the interior of said hard container at a low temperature.

13. The hard container as set forth in claim 10, wherein the gas-permeable material comprises at least one of perforated panels, mesh members, and net members.

14. The hard container as set forth in claim 10, wherein the impermeable thin material comprises at least one of aluminum foil, synthetic resin sheet, sheet metal, and non-woven fabrics.

15. A method for transporting/storing chilled goods at a low temperature, comprising the steps of:

providing a heat-insulated and hermetically-sealed space chamber for containing said chilled goods being loaded, transported and stored therein;

providing a supply area of a liquefied gas such as liquid carbon dioxide, liquefied nitrogen and the like in an upper portion of said space chamber;

generating snow by supplying said liquefied gas to a said supply area;

rapidly chilling the interior of said space chamber by means of said snow thus generated;

ventilating the interior of said space chamber by means of a gaseous-phase portion of said liquefied gas thus supplied to said supply area;

whereby the interior of said space chamber is kept thereafter at the substantially same temperature as that of a surface of the chilled goods.

16. The method for transporting/storing the chilled goods at the low temperature, as set forth in claim 12, characterized in that:

said supply area of said liquefied gas has its bottom and/or side surface constructed of a gas-permeable material such as perforated panels, mesh members, net members and like materials.

17. The method for transporting/storing the chilled goods at the low temperature, as set forth in claim 12, characterized in that:

said supply area of said liquefied gas has its bottom and/or side surface constructed of a gas-impermeable thin material such as aluminum foil, synthetic resin sheet or thin panels, metal sheet, non-woven fabrics and like materials.

18. A container for transporting chilled goods at a low temperature, comprising:

a thermally-insulated compartment having a freight compartment for the goods;

a snow support disposed above the freight compartment;

an expanding nozzle, for making dry ice snow, discharging onto the snow support;

a high-pressure liquid carbon dioxide tank, coupled to the nozzle; and control means for discharging liquid carbon dioxide through the nozzle to generate snow to cool the chilled goods;

wherein:

the snow support is permeable to gas and impermeable to the snow, whereby convective gas flows through the snow support by convection to cool the chilled goods.

19. The container according to claim 18, wherein the snow support comprises segments separated by partitions and a respective plurality of nozzles.

* * * * *